US010724127B2

(12) United States Patent
Dangerfield et al.

(10) Patent No.: US 10,724,127 B2
(45) Date of Patent: Jul. 28, 2020

(54) LOW DENSITY ALUMINUM-COPPER-LITHIUM ALLOY EXTRUSIONS

(71) Applicant: Universal Alloy Corporation, Canton, GA (US)

(72) Inventors: Victor B. Dangerfield, Canton, GA (US); Justin D. Lamb, Canton, GA (US)

(73) Assignee: Universal Alloy Corporation, Canton, GA (US)

( * ) Notice: Subject to any disclaimer, the term of this patent is extended or adjusted under 35 U.S.C. 154(b) by 151 days.

(21) Appl. No.: 15/884,880

(22) Filed: Jan. 31, 2018

(65) Prior Publication Data

US 2019/0032180 A1 Jan. 31, 2019

Related U.S. Application Data

(60) Provisional application No. 62/452,786, filed on Jan. 31, 2017.

(51) Int. Cl.
*C22C 21/12* (2006.01)
*C22C 21/14* (2006.01)
(Continued)

(52) U.S. Cl.
CPC ..... *C22F 1/057* (2013.01); *B21C 23/002* (2013.01); *C22C 21/12* (2013.01); *C22C 21/14* (2013.01); *C22C 21/16* (2013.01); *C22C 21/18* (2013.01)

(58) Field of Classification Search
CPC ..... C22F 1/057; B21C 23/002; C22C 21/12; C22C 21/14; C22C 21/16; C22C 21/18
(Continued)

(56) References Cited

U.S. PATENT DOCUMENTS 5,151,136 A 9/1992 Witters et al.
5,211,910 A 5/1993 Pickens et al.
(Continued)

FOREIGN PATENT DOCUMENTS

CN 101967589 B * 2/2013
EP 0266741 A1 5/1988
(Continued)

OTHER PUBLICATIONS

English language machine translation of CN-101967589-B to Gong et al. Generated Nov. 21, 2019 (Year: 2019).*
(Continued)

*Primary Examiner* — Brian D Walck
(74) *Attorney, Agent, or Firm* — Alan G. Towner; Christopher J. Owens; Leech Tishman Fuscaldo & Lampl

(57) ABSTRACT

An improved aluminum based alloy containing lithium is disclosed. The alloy may be provided as extruded aluminum-copper-lithium products having improved combinations of strength, fracture toughness, corrosion resistance and relatively low density. The extrusion alloy may include from 2.6 to 3.0 weight percent Cu, from 1.4 to 1.75 weight percent Li, from 0.0 to 0.25 weight percent Mn, from 0.10 to 0.45 weight percent Mg, from 0.05 to 0.15 weight percent Zr, from 0.00-0.10 weight percent Ti, from 0.10 weight percent maximum Si, from 0.12 weight percent maximum Fe, from 0.20 weight percent maximum Zn, and the balance Al and incidental impurities. The alloy should also be essentially Ag-free with Ag only being an accidental impurity in levels less than 0.05 weight percent maximum. In certain embodiments, the aluminum-copper-lithium alloys may be provided in the form of extruded products having improved combinations of strength and fracture toughness.

55 Claims, 12 Drawing Sheets

(51) Int. Cl.

| | |
|---|---|
| ***C22C 21/16*** | (2006.01) |
| ***C22C 21/18*** | (2006.01) |
| ***C22F 1/057*** | (2006.01) |
| ***B21C 23/00*** | (2006.01) |

(58) Field of Classification Search
USPC ..... 148/690
See application file for complete search history.

(56) References Cited

U.S. PATENT DOCUMENTS

| | | | |
|---|---|---|---|
| 5,234,662 | A | 8/1993 | Balmuth et al. |
| 5,259,897 | A | 11/1993 | Pickens et al. |
| 5,389,165 | A | 2/1995 | Cho |
| 5,455,003 | A | 10/1995 | Pickens et al. |
| 5,972,110 | A | 10/1999 | Chakrabarti et al. |
| 7,229,509 | B2 | 6/2007 | Cho |
| 8,118,950 | B2 | 2/2012 | Colvin et al. |
| 8,323,426 | B2 | 12/2012 | Danielou |
| 8,366,839 | B2 | 2/2013 | Heymes et al. |
| 8,845,827 | B2 | 9/2014 | Yanar et al. |
| 2012/0225271 | A1 | 9/2012 | Boselli et al. |

FOREIGN PATENT DOCUMENTS

| | | | |
|---|---|---|---|
| EP | 0325937 | A1 | 8/1989 |
| EP | 1359232 | A2 | 5/2003 |
| EP | 1891247 | B1 | 11/2008 |
| EP | 2508642 | B1 | 1/2014 |

OTHER PUBLICATIONS

Aigbodion, "Quantitative interpretation of differential scanning calorimetry heat effect in A2009 aluminum alloy", The Pacific Journal of Science and Technology, 2013, vol. 14, pp. 16-25.

Augis et al., "Calculation of the Avrami parameters for heterogeneous solid state reactions using a modification of the Kissinger method", Journal of Thermal Analysis, 1978, vol. 13, pp. 283-292.

Moran et al., "Corrosion performance of new generation aluminum-lithium alloys for aerospace applications", The proceedings of the 13th International Conference on Aluminum Alloys, 2012, pp. 425-430.

Moran et al., "Improvements in corrosion resistance offered by newer generation 2x99 aluminum-lithium alloys for aerospace applications", The Proceedings of the 12th International Conference on Aluminum Alloys, 2010, pp. 1492-1497.

* cited by examiner

LOW DENSITY ALUMINUM-COPPER-LITHIUM ALLOY EXTRUSIONS

CROSS-REFERENCE TO RELATED APPLICATION

This application claims the benefit of U.S. Provisional Patent Application Ser. No. 62/452,786, filed on Jan. 31, 2017, which is incorporated herein by reference.

FIELD OF INVENTION

This invention relates to aluminum-copper-lithium alloy wrought products, and more particularly Al—Cu—Li alloy compositions and processing methods that provide extruded products having improved properties.

BACKGROUND INFORMATION

Conventional aluminum-lithium alloys often contain copper, magnesium, and may also contain manganese and/or zirconium in some cases. Aluminum alloys containing lithium additions are beneficial because lithium reduces the density of aluminum alloys by about three percent and increases the modulus of elasticity by about five percent for every weight percent of lithium added. However, the addition of lithium to aluminum alloys may also result in a decrease in ductility and fracture toughness. For use in aircraft parts and aerospace components an alloy should have excellent fracture toughness and strength properties, but it will be appreciated that both high-strength and high-fracture toughness are difficult to obtain in conventional alloys. Furthermore, in order for lithium-containing aluminum alloys to be selected for aerospace or aircraft components, their performance must reach that of alloys commonly used, particularly in the compromise between static mechanical strength and damage tolerance, which are generally antinomic. Said alloys must also have good corrosion resistance. It will be appreciated that the alloys must also be processed in a manner to adequately control the balance of strength, toughness, corrosion resistance, and density.

Materials cost is a major concern in the aerospace industry. One method to reduce the cost of extruded aluminum alloy products is to cut down on the raw material cost. The addition of silver, especially in the presence of magnesium, has proven beneficial in aluminum-copper-lithium alloys. For example, silver is intentionally added to registered aluminum-copper-lithium alloys AA2050, AA2055, AA2075, AA2085, AA2094, AA2095, AA2195, AA2295, AA2395, AA2196, AA2296, AA2098, and AA2198, but silver additions can add significant raw materials costs to a product. Therefore, a more desirable alloy would be essentially silver-free with silver only being an impurity. It will be appreciated that a silver-free aluminum-copper-lithium alloy that still maintains high strength levels, high fracture toughness, and low density would be a desirable aluminum-copper-lithium product.

SUMMARY OF THE INVENTION

The present invention provides improved aluminum based alloys containing lithium and methods of making extruded products therefrom. The alloy may be provided as a wrought aluminum-copper-lithium extrusion having improved combinations of strength, fracture toughness, corrosion resistance, and relatively low density. The alloy may include, in weight percent, 2.6-3.0 Cu, 1.4-1.75 Li, 0.10-0.45 Mg, 0.0-0.25 Mn, 0.05-0.15 Zr, and the balance aluminum and incidental impurities. The alloy may be essentially Ag-free, with Ag only being present as an impurity at an amount less than or equal to 0.05 weight percent. Furthermore, the alloy may only include a maximum weight percent of Zn of 0.20. The aluminum-copper-lithium alloys may be provided in the form of extruded products having improved combinations of strength and fracture toughness.

An aspect of the present invention is to provide an extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product comprises ≤25% recrystallized grains, and has a L-T fracture toughness $K_Q$ of at least 34 ksi √in and a L tensile yield strength of at least 72 ksi.

Another aspect of the present invention is to provide an extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product comprises ≤25% recrystallized grains, and has a T-L fracture toughness $K_Q$ of at least 33 ksi √in and a L-T tensile yield strength of at least 67 ksi.

A further aspect of the present invention is to provide an extruded aluminum alloy product comprising from, in weight percent, 2.8-3.0 Cu, 1.4-1.6 Li, 0.1-0.25 Mg, 0.05 max Mn, 0.2 max Zn, 0.05 max Ag, 0.05 max Si, 0.07 max Fe, 0.09-0.13 Zr, 0-0.06 Ti, and the balance Al and incidental impurities, wherein the extruded aluminum alloy product comprises ≤25% recrystallized grains, and has a L-T fracture toughness $K_Q$ of greater than 42 ksi √in.

A further aspect of the present invention is to provide an extruded aluminum alloy product comprising from, in weight percent, 2.7-2.9 Cu, 1.55-1.75 Li, 0.3-0.4 Mg, 0.1-0.2 Mn, 0.2 max Zn, 0.05 max Ag, 0.05 max Si, 0.07 max Fe, 0.09-0.13 Zr, 0-0.06 Ti, and the balance Al and incidental impurities, wherein the extruded aluminum alloy product comprises ≤25% recrystallized grains, and has a L tensile yield strength greater than 74 ksi.

Another aspect of the present invention is to provide a method of making an extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product has less than or equal to 25% recrystallized grains, the method comprising homogenizing a cast billet or shape of the aluminum alloy, hot working the billet or shape into an extruded product, subjecting the extruded product to a solution heat treatment at a temperature of from 940° F. to 1020° F., quenching the solution heat treated extruded product, stretching the extruded product to a permeant set of 3-9%, and artificially aging the extruded product by heating to at least one temperature of from 290° F. to 315° F. for 36-100 hours.

A further aspect of the present invention is a method of making an extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product has less than or equal to 25% recrystallized grains, the method comprising homogenizing a cast billet or shape of the aluminum alloy, hot working the billet or shape into an extruded product, subjecting the extruded product to a solution heat treatment at a temperature greater than or equal to 970° F., quenching the solution heat treated extruded product, stretching the extruded product to a permeant set of 3-9%, and artificially aging the extruded product by heating to at least one temperature of from 290° F. to 315° F. for 12-36 hours.

These and other aspects of the present invention will be more apparent from the following description.

DETAILED DESCRIPTION

Unless otherwise specified, all the indications relating to the chemical composition of the alloys are expressed as percentage by weight based on the total weight of the alloy. References to commercially known alloys, when applicable, are named in accordance with the regulations of The Aluminum Association, known to those skilled in the art. The density of an alloy depends on its composition and can be calculated, when not physically measured, in accordance with The Aluminum Association procedure, which is described on pages 2-12 and 2-13 of "Aluminum Standards and Data 2013." The definitions of alloy tempers are also given in "Aluminum Standards and Data 2013" on pages 1-6 through 1-10.

Figure 1:
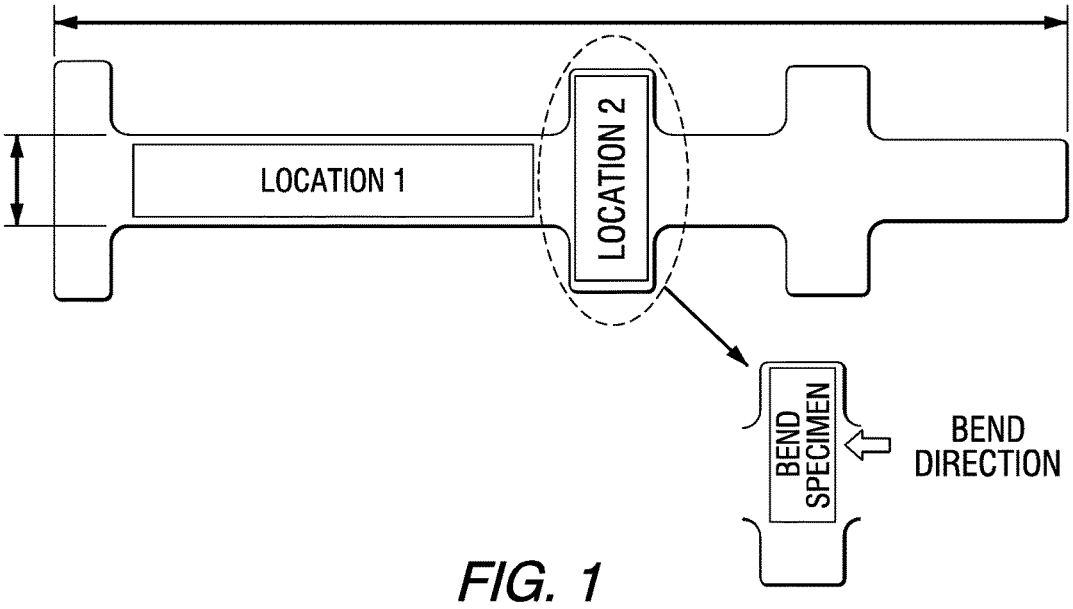
FIG. 1 is a cross-sectional view of an Al—Cu—Li alloy extrusion in accordance with an embodiment of the present invention.
Figure 17:
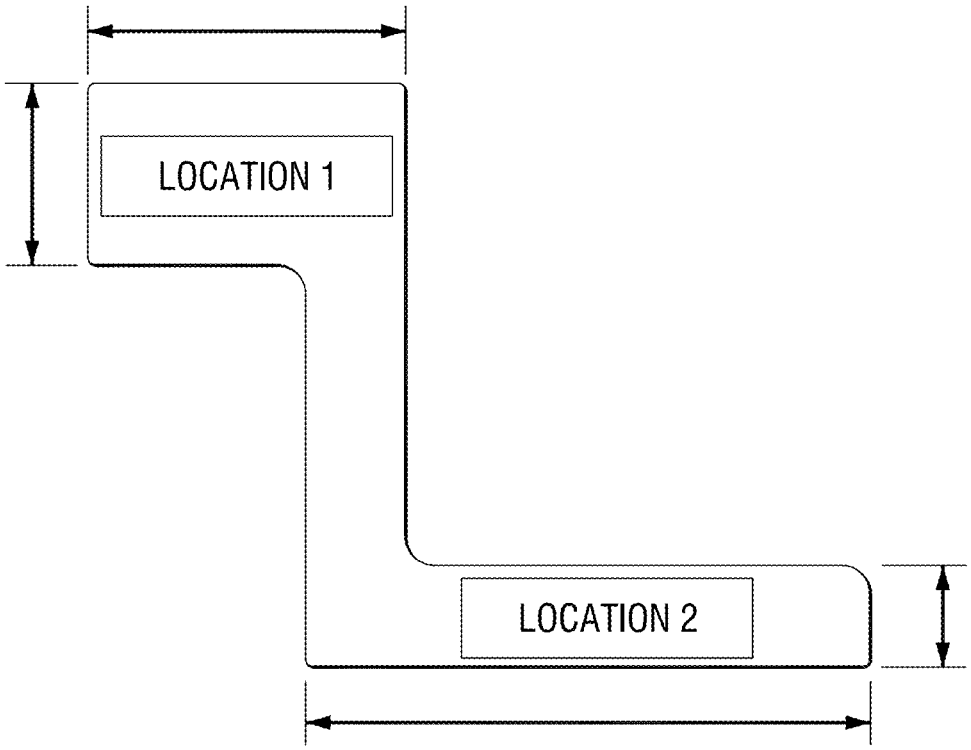
FIG. 17 is a cross-sectional view of an Al—Cu—Li alloy extrusion in accordance with an embodiment of the present invention.
Figure 19:
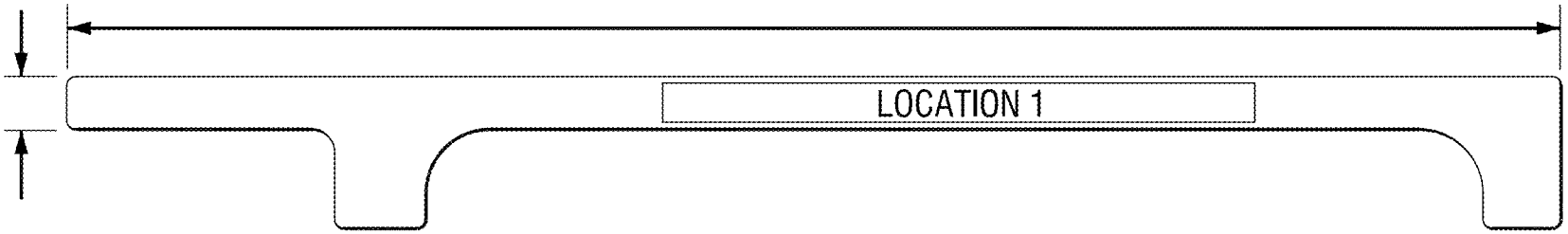
FIG. 19 is a cross-sectional view of an Al—Cu—Li alloy extrusion in accordance with an embodiment of the present invention.

FIG. 1 illustrates an extrusion shape according to an embodiment of the present invention. It is known that the mechanical properties of extrusions can be affected by the aspect ratio of the extruded section tested. Herein, the aspect ratio of an extruded section is defined as the ratio of the width (W) to the height (H) of an uninterrupted section. For example, a 1 inch high by 3 inch wide bar would have an aspect ratio equal to 3. As used herein, the term "high aspect ratio" means a section of an extrusion having an aspect ratio greater than or equal to 7. As used herein, the term "low aspect ratio" means a section of an extrusion having an aspect ratio less than or equal to 4. As used herein, the term "medium aspect ratio" means a section of an extrusion having an aspect ratio between 4 and 7. It is also known that complex extrusions like those shown in FIGS. 1, 17 and 19 can have multiple sections with different aspect ratios. In general, low aspect ratio sections can have high L tensile strengths coupled with low L-T tensile strengths whereas in high aspect ratio sections the L and L-T tensile strength may be more isotropic.

It is also known that the orientations of extruded sections are based on the localized grain flow in the extruded section, and therefore in complex extrusions there is no global orientation system governing the entire extruded body. It is also known that regions in complex extrusions can have complex grain flows which cannot be easily defined by a simple orientation system. These regions are defined herein as transition zones, and when tested can potentially exhibit mechanical properties akin to those tested in off-axis orientations depending on several factors including sample location, sample size, grain flow, and testing direction. The transition zones are created at the intersection of various extrusion features. For example, transition zones may be formed at joints or different legs of the same extrusion. As shown in FIG. 1, there may be a transition zone extending into location 1 and location 2.

The transition zones may exhibit poor mechanical properties, e.g., ductility, depending on the interaction between localized grain flow and part machining/loading. The extrusions of the present invention include an improved combination of properties throughout the entire extruded body, including the transition zones, that may provide the extrusions with an enhanced resistance to failure.

The present invention provides aluminum based alloys suitable for forming into extruded products having improved combinations of strength, fracture toughness, and corrosion resistance, with a density between 0.094-0.096 lbs/in$^3$, for example, about 0.095 lbs/in$^3$. The alloys may comprise, in weight percent, 2.6-3.0 Cu, 1.4-1.75 Li, 0.10-0.45 Mg, 0.0-0.25 Mn, 0.20 max Zn, 0.05 max Ag, 0.10 max Si, 0.12 max Fe, 0.05-0.15 Zr, and 0-0.10 Ti with minor impurities also present. These compositional ranges are listed as embodiment I in Table 1.

In certain embodiments, the alloys of the present invention can contain, in weight percent, 2.8-3.0 Cu, 1.4-1.6 Li, 0.10-0.25 Mg, 0.05 max Mn, 0.20 max Zn, 0.05 max Ag, 0.05 max Si, 0.07 max Fe, 0.09-0.13 Zr, and 0-0.06 Ti. The balance aluminum and minor impurities. The calculated density of the alloy composition in accordance with this embodiment may be about 0.0952 lbs/in$^3$. The alloy of the present invention could also optionally contain Sc up to 0.40 weight percent. These compositional ranges are listed as embodiment II in Table 1.

An alloy composition in accordance with an embodiment of the present invention may contain, in weight percent, 2.8-3.0 Cu, 1.4-1.6 Li, 0.15-0.25 Mg, 0.05 max Mn, 0.05 max Zn, 0.05 max Ag, 0.05 max Si, 0.05 max Fe, 0.09-0.13 Zr, and 0-0.05 Ti. The balance aluminum and minor impurities. The calculated density of the alloy composition in accordance with this embodiment may be about 0.0954 lbs/in$^3$. These compositional ranges are listed as embodiment III in Table 1.

A specific example of an alloy composition within the compositional ranges of embodiments II and III may contain, in weight percent, 2.89 Cu, 1.54 Li, 0.2 Mg, 0.04 Mn, 0.01 Zn, 0 Ag, 0.04 Si, 0.03 Fe, 0.1 Zr, and 0.03 Ti. The balance aluminum and minor impurities. This example alloy composition is listed as embodiment IV in Table 1.

An alloy composition in accordance with an embodiment of the present invention may contain, in weight percent, 2.7-2.9 Cu, 1.55-1.75 Li, 0.3-0.4 Mg, 0.1-0.2 Mn, 0.2 max Zn, 0.05 max Ag, 0.05 max Si, 0.07 max Fe, 0.09-0.13 Zr, and 0-0.06 Ti. The balance aluminum and minor impurities. The calculated density of the alloy composition in accordance with this embodiment may be about 0.0953 lbs/in$^3$. These compositional ranges are listed as embodiment V in Table 1.

Another alloy composition in accordance with an embodiment of the present invention may contain, in weight percent, 2.7-2.9 Cu, 1.6-1.7 Li, 0.3-0.4 Mg, 0.1-0.2 Mn, 0.05 max Zn, 0.05 max Ag, 0.05 max Si, 0.05 max Fe, 0.09-0.13 Zr, and 0-0.05 Ti. The balance aluminum and minor impurities. The calculated density of the alloy composition in accordance with this embodiment may be about 0.0949 lbs/in$^3$. These compositional ranges are listed as embodiment VI in Table 1.

A specific example of an alloy composition within the compositional ranges of embodiments V and VI may contain, in weight percent, 2.75 Cu, 1.54 Li, 0.36 Mg, 0.13 Mn, 0 Zn, 0 Ag 0.03 Si, 0.05 Fe, 0.11 Zr, and 0.03 Ti. The balance aluminum and minor impurities. This example alloy composition is listed as embodiment VII in Table 1.

based alloy with a unique combination of strength and toughness while maintaining meaningful reductions in density.

In certain embodiments, the addition of Cu, particularly in the ranges set forth herein above for use in accordance with the present invention, provides the capability of yielding high strength and fracture toughness. In accordance with certain embodiments, the Cu content may be selected to develop an alloy with a desirable combination of strength and toughness without sacrificing density.

While the inventors do not wish to be held to any theory of invention, it is believed the improved combinations of strength and toughness are due to the desired precipitation of the $T_1$ phase over δ-type precipitates, which could be due to maintaining a high Cu:Li ratio. In accordance with certain embodiments, the Cu:Li ratio may be greater than 1.45:1, or greater than 1.6:1. For example, the Cu:Li ratio may range from 1.6:1 to 2.15:1, or from 1.65:1 to 2.0 to 1.

In certain embodiments, Mg may be added to increase strength, although additions of Mg do slightly decrease density. It is important to control Mg additions as excess Mg can lead to poor fracture toughness through the formation of undesirable phases at the grain boundaries. Although additions of Mn can be added as a grain structure controlling element, in certain embodiments low Mn levels may be utilized for the purpose of mainly solid solution strengthening. Even though Mn-type dispersoids and other intermetallic phases may be present in the microstructure they are not the purpose of the alloying addition. It is desirable to retain Mn in solid solution in the final extruded product as much as possible.

While not intending to be bound by any particular theory, it is believed that having low Mn (less than 0.25 weight percent) avoids the formation of $Al_xMn_xCu_x$-type dispersoids, and allows more Cu to be available for the formation of the $T_1$ phase. Similarly, it is believed that having low Mg levels (0.10-0.45 weight percent) avoids the formation of S-phase ($Al_2CuMg$)-type phases also freeing up Cu for the formation of the $T_1$ phase. Conversely, Mg additions are believed to aid in the formation of the $T_1$ phase due to its high vacancy binding energy. Therefore, it is apparent that an optimum balance of Mg must be achieved to maximum the $T_1$ phase present in an Al—Cu—Li alloy. Having low levels of Mg and Mn can lead to low work hardening and improve toughness with a loss in strength. In certain embodiments, in order to improve strength, Mn can be added in levels just high enough to provide solid solution strengthening and to aid in work hardening. Likewise, Mg

TABLE 1

| | Compositional range (weight percent) balance aluminum and impurities | | | | | | | | | |
|---|---|---|---|---|---|---|---|---|---|---|
| | Cu | Li | Mg | Mn | Zn | Ag | Si | Fe | Zr | Ti |
| I | 2.6-3.0 | 1.4-1.75 | 0.10-0.45 | 0.0-0.25 | ≤0.2 | ≤0.05 | ≤0.10 | ≤0.12 | 0.05-0.15 | 0.00-0.10 |
| II | 2.8-3.0 | 1.4-1.6 | 0.1-0.25 | ≤0.05 | ≤0.2 | ≤0.05 | ≤0.05 | ≤0.07 | 0.09-0.13 | 0.00-0.06 |
| III | 2.8-3.0 | 1.4-1.6 | 0.15-0.25 | ≤0.05 | ≤0.05 | ≤0.05 | ≤0.05 | ≤0.05 | 0.09-0.13 | 0.00-0.05 |
| IV | 2.89 | 1.54 | 0.2 | 0.04 | 0.01 | 0 | 0.04 | 0.03 | 0.10 | 0.03 |
| V | 2.7-2.9 | 1.55-1.75 | 0.3-0.4 | 0.1-0.2 | ≤0.2 | ≤0.05 | ≤0.05 | ≤0.07 | 0.09-0.13 | 0.00-0.06 |
| VI | 2.7-2.9 | 1.6-1.7 | 0.3-0.4 | 0.1-0.2 | ≤0.05 | ≤0.05 | ≤0.05 | ≤0.05 | 0.09-0.13 | 0.00-0.05 |
| VII | 2.75 | 1.64 | 0.36 | 0.13 | — | 0 | 0.03 | 0.05 | 0.11 | 0.03 |

In the present invention, Li improves tensile and yield strengths as well as elastic modulus in addition to permitting a significant decrease in density. Additionally, Li additions may improve fatigue resistance. In accordance with certain embodiments, the addition of Li can result in an aluminum can also be added to assist in the formation of $T_1$ and increase the work hardening ability of the alloy.

In certain embodiments, Zr may be added as a grain structure controlling element, although other grain controlling materials such as Sc, Ti, Hf, Cr, or combinations thereof could be utilized. The amount of Zr alloyed into a product is dictated by whether a recrystallized or unrecrystallized grain structure is desired.

The aluminum-copper-lithium extruded products may be substantially free of Ag. As used herein, the term "substantially free" when referring to alloying additions, means that a particular element or material is not purposefully added to the alloy, and is only present, if at all, in minor amounts as an impurity. For example, in impurity amounts of less than 0.05 weight percent, or less than 0.02 weight percent, or less than 0.01 weight percent.

In certain embodiments, Zn may optionally be added to Al—Cu—Li alloys to improve strength and corrosion resistance as long as the Mg:Zn ratio is less than 1. However, Zn can also increase the density of an alloy, and in embodiments of the present invention should be kept below 0.2 weight percent. In certain embodiments, the aluminum-copper-lithium extruded products may be substantially free of Zn.

Extruded products made from Al—Cu—Li alloys of the present invention have been found to possess favorable properties including improved combinations of strength and fracture toughness, improved corrosion resistance, and relatively low density.

Unless mentioned otherwise, static mechanical characteristics, in other words the ultimate tensile strength (UTS), tensile yield strength (TYS), and the elongation at fracture (e), are determined by a tensile test according to standard ASTM B557—Standard Test Methods for Tension Testing Wrought and Cast Aluminum- and Magnesium-Alloy Products.

Unless mentioned otherwise, fracture toughness is evaluated according to ASTM B645—Standard Practice for Linear-Elastic Plane-Strain Fracture Toughness Testing of Aluminum Alloys. ASTM B645 also references ASTM E 399—Standard Test Method for Linear-Elastic Plane-Strain Fracture Toughness $K_{1C}$ of Metallic Materials.

As used herein, the term "exfoliation corrosion rating" means results corresponding to MASTMASSIS corrosion testing done according to ASTM G85—Annex 2. Resistance to exfoliation corrosion may be evaluated by exposing the aluminum based alloys according ASTM standard G85—Standard Practice for Modified Salt Spray (FOG) Testing, specifically Annex 2—Cyclic Acidified Salt Fog Testing, and the results were evaluated according to ASTM standard G34—Standard Test Method for Exfoliation Corrosion Susceptibility in 2xxx and 7xxx Series Aluminum Alloys. The samples were exposed according to ASTM G85—Annex 2 instead of ASTM G34 as the corrosion resistance of Al—Cu—Li type alloys during seacoast exposure cannot be correlated to ASTM G34 exposures as shown by Morin et al. "Improvements in corrosion resistance offered by newer generation 2×99 aluminum-lithium alloys for aerospace applications" from The Proceedings of the 12th International Conference on Aluminum Alloys, p. 1492-1497, 2010, and Morin et al. "Corrosion performance of new generation aluminum-lithium alloys for aerospace applications" from The Proceedings of the 13th International Conference on Aluminum Alloys, p. 425-430, 2012.

Unless mentioned otherwise, resistance to intergranular corrosion (IGC) is evaluated according to ASTM G110—Standard Practice for Evaluating Corrosion Resistance of Heat Treatable Aluminum Alloys by Immersion in Sodium Chloride+Hydrogen Peroxide Solution. For IGC testing, the maximum depth of attack in μm and the frequency of IGC attack (number of attacks per inch) were calculated.

Unless mentioned otherwise, cryogenic tensile and cryogenic fracture testing refers to testing performed at −320° F.

Unless mentioned otherwise, three-point bend testing is performed according to standard BS EN 2563 (1997). The displacement of the loading nose is defined herein as d. In accordance with an embodiment of the present invention, the three-point bend testing may be performed at transition zones and provide an off-axis three-point bend displacement d value. The three-point displacement d may provide the final displacement at failure.

Unless mentioned otherwise, fatigue testing is performed according to ASTM E466-15—Standard Practice for Conducting Force Controlled Constant Amplitude Axial Fatigue Tests of Metallic Materials, using open hole $K_t$ of 2.3 and T-type specimens with a minimum/maximum load ratio R of 0.1 at a frequency of 30 Hz.

Unless mentioned otherwise, fatigue crack growth rate testing is performed according to ASTM E647-15—Standard Test Method for Measurement of Fatigue Crack Growth Rates, using CC(t) center crack tension specimens with a nominal width (W) of 4 in and thickness (B) of 0.2 in. The specimens are pre-cracked and then tested at room temperature with a stress ratio of 0.1 at a cyclic frequency of 10 Hz. Specimens are tested in either a lab air (humidity 26-42%) or a humid air (humidity >90%) environment.

In accordance with certain embodiments, the extruded aluminum alloy products of the present invention may have a L-T fracture toughness $K_Q$ of at least 34 ksi √in and a L tensile yield strength of at least 72 ksi. In certain embodiments, the extruded aluminum alloy products of the present invention may have a L-T fracture toughness $K_Q$ greater than 40 ksi √in and a L tensile yield strength greater than 75 ksi. In other embodiments, the extruded aluminum alloy products of the present invention may have a T-L fracture toughness $K_Q$ of at least 33 ksi √in and a L-T tensile yield strength of at least 67 ksi.

In accordance with certain embodiments, desirable combinations of fracture toughness and tensile yield strength are achieved. For example, the combination of L-T fracture toughness $K_Q$ (ksi √in) and L tensile yield strength (ksi) may be greater than or equal to the following equation: L-T $K_Q$>38−2.5*[L TYS−76]. Similarly, the combination of T-L fracture toughness $K_Q$ and L-T tensile yield strength may be improved. As more fully described below, extruded aluminum alloy products in accordance with embodiments of the invention have been found to produce such improved combinations of fracture toughness and tensile yield strength.

In accordance with certain embodiments, the extruded aluminum alloy products of the present invention may have an off-axis three-point bend displacement d measured at a transition zone of greater than 0.55 mm, or greater than 0.6 mm, or greater than 0.75 mm, or greater than 0.95 mm, or at least 0.99 mm.

In accordance with certain embodiments, the extruded aluminum alloy products of the present invention may have a cryogenic L-T fracture toughness $K_{1C}$ of greater than 47 ksi √in, for example, greater than 48.5 ksi √in.

In accordance with certain embodiments, the extruded aluminum alloy products of the present invention may have an exfoliation corrosion rating of at least EB. For example, the extruded aluminum alloy products may have an exfoliation corrosion rating of EA.

In accordance with certain embodiments, the extruded aluminum alloy products of the present invention may have a L elongation of at least 9.5 percent, for example, greater than 10.5 percent.

In accordance with certain embodiments, the extruded aluminum alloy products of the present invention may have a L tensile yield strength of at least 64 ksi and a L-T fracture toughness $K_Q$ of at least 60 ksi √in. In certain embodiments, the extruded aluminum alloy products may have a fatigue crack growth rate less than or equal to 1E-8 (ΔK)^2.4994 when Δk=30-50 ksi √in.

In accordance with an embodiment of the present invention, the extrusion may be formed as a high toughness composition listed as embodiment II in Table 1. By including a relatively small addition of Mn in an amount of 0.05 weight percent or less when extruded into the body shown in FIG. 1, the extrusion may have certain properties when tested at locations 1 and 2, as shown in FIG. 1.

In certain embodiments, location 1 of the extrusion having a high toughness composition may have a L-T fracture toughness $K_Q$ of at least 36 ksi √in, or at least 38 ksi √in, or at least 40 ksi √in, or at least 42 ksi √in, or at least 44 ksi √in, or at least 45 ksi √in, or at least 47.5 ksi √in.

In certain embodiments, location 1 of the extrusion having a high toughness composition may have a T-L fracture toughness $K_Q$ of at least 30 ksi √in, or at least 31 ksi √in, or at least 33 ksi √in, or at least 35 ksi √in, at least 37 ksi √in, or at least 39 ksi √in.

In certain embodiments, location 1 of the extrusion having a high toughness composition may have a L tensile yield strength of at least 68 ksi, or at least 70 ksi, or at least 71 ksi, or at least 72 ksi, or at least 74 ksi.

In certain embodiments, location 1 of the extrusion having a high toughness composition may have a L-T tensile yield strength of at least 60 ksi, or at least 62 ksi, or at least 64 ksi, or at least 66 ksi, or at least 68 ksi.

In certain embodiments, location 1 of the extrusion having a high toughness composition may have a L elongation of at least 10 percent, or at least 12 percent, or at least 14 percent.

In certain embodiments, location 2 of the extrusion having a high toughness composition may have an off-axis three-point bend displacement d of at least 0.5 mm, or at least 0.75 mm, or at least 0.8 mm, or at least 0.9 mm, or at least 0.95 mm, or at least 0.99 mm. The increased displacement value provides enhanced resistance to failure at a location of the extrusion that may often be a point of failure.

In accordance with an embodiment of the present invention, the extrusion may be formed as a high strength composition listed as embodiment V in Table 1. By including a relatively high amount of Mn in an amount of 0.10-0.20 weight percent when extruded into the body shown in FIG. 1, the extrusions may have certain properties when tested at locations 1 and 2, as shown in FIG. 1.

In certain embodiments, location 1 of the extrusion having a high strength composition may achieve a L-T fracture toughness $K_Q$ of at least 32 ksi √in, or at least 34 ksi √in, or at least 36 ksi √in, or at least 38 ksi √in, or at least 40 ksi √in, or at least 41 ksi √in.

In certain embodiments, location 1 of the extrusion having a high strength composition may have a T-L fracture toughness $K_Q$ of at least 27 ksi √in, or at least 29 ksi √in, or at least 31 ksi √in, or at least 33 ksi √in, or at least 35 ksi √in.

In certain embodiments, location 1 of the extrusion having a high strength composition may have a L tensile yield strength of at least 73 ksi, or at least 74 ksi, or at least 75 ksi, or at least 76 ksi, or at least 77 ksi.

In certain embodiments, location 1 of the extrusion having a high strength composition may have a L-T tensile yield strength of at least 68 ksi, or at least 69 ksi, or at least 71 ksi, or at least 72.5 ksi.

In certain embodiments, location 1 of the extrusion having a high strength composition may have a L elongation of at least 9 percent, or at least 10.5 percent, or at least 11.5 percent.

In certain embodiments, location 2 of the extrusion having a high strength composition may have an off-axis three-point bend displacement d of at least 0.4 mm, or at least 0.45 mm, or at least 0.5 mm, or at least 0.55 mm, or at least 0.6 mm. The increased displacement value provides enhanced resistance to failure at a location of the extrusion that may often be a point of failure.

In accordance with an embodiment of the present invention, the following method may be followed using the alloy compositions of this invention, in order to obtain an extruded alloy with the desired combinations of strength, fracture toughness, corrosion resistance, and ductility. In certain embodiments, equivalent homogenization times and aging times may be calculated when multi-step homogenization and aging practices are utilized. An equivalent time at a temperature during homogenization or aging is given by the following equation:

$$\frac{t_1}{t_2} = \exp\left[\frac{Q}{R}\left(\frac{1}{T_1} - \frac{1}{T_2}\right)\right]$$

Where $t_1$ and $t_2$ are times in hours, $T_1$ and $T_2$ are temperatures in degrees Kelvin, Q is the activation energy, and R is the universal gas constant.

In accordance with an embodiment of the present invention, the method relates to the manufacturing process for an extruded aluminum product. First, a liquid metal bath is prepared to obtain an aluminum alloy having a composition in accordance with an embodiment of the present invention. The alloy is manufactured by casting a billet, ingot, or shape from a liquid metal bath, for example, by using direct-chill casting.

The unwrought shape is homogenized such that at least one step is at a temperature between 820° F. and 870° F. such that the equivalent time at 970° F. of the step using a Q=125.6 kJ/mol and R=8.314462 $JK^{-1}$ $mol^{-1}$ according to the equation:

$$\frac{t_1}{t_2} = \exp\left[\frac{Q}{R}\left(\frac{1}{T_1} - \frac{1}{T_2}\right)\right]$$

is between 0.25 and 10 hours, and at least one step is at a temperature greater than 940° F. such that the total equivalent time of the entire homogenization process is between 7 and 35 hours. For example, the unwrought shape may be homogenized with a two-step homogenization process. A first step of the homogenization process may be performed at a temperature of at least 820° F., or from 820° F. to 870° F., or from 830° F. to 860° F. The first step of the homogenization process may be for a treatment time of at least 1 hour, or from 5 to 30 hours, or from 10 to 20 hours. A second step of the homogenization process may be performed at a temperature of at least 940° F., or from 930° F. to 1000° F., or from 940° F. to 980° F. The second step of the homogenization process may be for a treatment time of at least 1 hour, or from 2 to 40 hours, or from 5 to 25 hours. In certain embodiments, a two-step homogenization process may be used, but a homogenization process with any other suitable number of steps may be used, e.g., one, three, four or more steps.

In accordance with an embodiment of the present invention, the unwrought product is then hot worked into an extruded product. In an embodiment of the present invention, the F-temper extrusion may optionally be cold worked. As used herein, the term "F-temper extrusion" means an extrusion that has been fabricated using a shaping process. In certain embodiments, the extruded product is then subjected to a solution heat treatment with at least one step greater than or equal to 950° F. and then quenched. In certain embodiments, the extruded product may be kept at an ambient temperature after it is quenched for a short period of time. The extruded product may then be stretched with a permanent set of 3-9%. In accordance with an embodiment of the present invention, the extruded product may be subjected to a natural aging period to produce a T3 temper after it is stretched. The extruded product is then artificially aged by heating the extruded product to a temperature less than or equal to 315° F. for a period of time. For example, the extruded product may be artificially aged for a treatment time of at least 10 hours, or from 12 to 200 hours, or from 20 to 150 hours, or from 30 to 100 hours.

In accordance with an embodiment of the present invention, an alloy composition of this invention is provided as a billet by techniques currently known in the art for fabrication into a suitable extruded product. Billets, ingots, or shapes may be preliminary worked or shaped to provide suitable stock for subsequent working operations. Prior to the principal working operation, the billets may be subject to stress relieving and homogenization. In certain embodiments, the homogenization process may precipitate out a good network of dispersoids (ex—$Al_3Zr$), which help control and refine the grain structure, and to homogenize the other alloyed elements (ex—Cu, Mg, etc.). In certain embodiments, in order to help precipitate out dispersoids when Zr is the main dispersoid forming element, a homogenization would contain at least one step, or alternatively a slow ramp, at a temperature of from 820° F. to 870° F., for example, from 830° F. and 860° F., such that the equivalent time of the step, or steps, or alternatively ramp, at 970° F. using a Q=125.6 kJ/mol and R–8.314462 $JK^{-1}$ $mol^{-1}$ is between 0.25 and 10 hours. Subsequent homogenization steps should be aimed at creating a homogenized dispersion of solute in the aluminum matrix while not over-coarsening the aforementioned precipitated dispersoids if an unrecrystallized extruded structure is desired. In certain embodiments, the homogenization would contain at least one step at a temperature greater than 940° F. such that the total equivalent time of the entire homogenization is between 7 and 35 hours. In another embodiment, longer homogenization times may be used as long as the dispersoids are not over-ripened. Alternatively, if a recrystallized structure is desired, longer homogenization times can be utilized.

After homogenization, the alloy is hot worked to form an extruded product. For example, the alloy could be extruded by techniques known to those in the art. The extruded product is then solution heat treated at a temperature of from 940° F. to 1020° F., but at a temperature less than the incipient melting temperature. For example, the extruded product may be solution heat treated at a temperature greater than 960° F., or greater than 970° F. or greater than 1000° F. In certain embodiments, the extruded product is solution heat treated between 1000° F. and 1020° F. Typical furnace off-sets can be as high as ±10° F. as known to those skilled in the art.

In accordance with certain embodiments, to produce an extruded product with an improved combination of strength, toughness, and corrosion resistance, the extruded product is rapidly quenched after solution heat treatment in order to minimize, and in certain embodiments prevent, the uncontrolled precipitation of phases in the alloy. After quenching, the alloy should be plastically deformed, e.g., via stretching, at an amount great enough to ensure a uniform distribution of lithium containing metastable precipitates during the artificial aging process. For example, an extrusion should be stretched from 1 to 9 percent, or from 2 to 6 percent, or from 3 to 5 percent, if high strength is desired. In certain embodiments, to provide a higher fracture toughness, the alloy may be stretched from 1 to 3 percent as long as some compromise in strength is acceptable. In certain embodiments, the product may be stretched less than or equal to 24 hours after quenching, for example, less than 2 hours after quenching, or less than an hour after quenching. During the time period between quenching and stretching the extruded product may be kept at room temperature, e.g., may be naturally aged for a short period of time. In certain embodiments, the resulting extrusion microstructure is largely not recrystallized, e.g., the percent of recrystallized grains may be less than or equal to 25 percent. For example, the percent of recrystallized grains may be less than 20 percent, or less than 15 percent, or less than 10 percent, or less than 7.5 percent, or less than 5 percent.

After the alloy product has been worked, it may optionally be naturally aged, e.g., at room temperature, until a stable T3 temper has been established. In certain embodiments, the alloy product is allowed to naturally age for at least 48 hours. After the alloy product has been naturally aged, it may be artificially aged to provide the desired combination of strength, toughness, and corrosion resistance. In accordance with an embodiment of the present invention, the aging practice can be adjusted using an equivalent time at temperature calculation based on the desired mechanical properties and production time constraints. In certain embodiments, the alloy product should be artificially aged at temperatures equal to or less than 315° F. for 12-80 hours. In other embodiments, the alloy product should be artificially aged at temperatures between 290-310° F. for 12-80 hours. Multi-step aging treatments can also be used as long as the equivalent time at 305° F. is between 12 and 80 hours using a Q=85.27 kJ/mol. To obtain an extruded alloy product having a peak aged temper, the alloy product should be aged at a temperature of from 290-310° F. for 36-80 hours. As used herein, the term "under-aged temper" means the extruded aluminum alloy undergoes an aging treatment selected so as to achieve an under-aged product with properties that differ from those attained from a conventional temper. To obtain an under-aged product, the alloy product should be aged at a temperature of from 290-310° F. for 12-36 hours. In certain embodiments, multi-step aging treatments can be used with equivalent time at 305° F. is between 42-54 hours for a peak aged product and 14-19 hours for an under-aged product. Typical furnace off-sets can be as high as ±10° F. as known to those skilled in the art.

Alloys according to the present invention, when properly processed, should have an improved combination of strength, fracture toughness, corrosion resistance, and density without the intentional alloying addition of Ag. In certain embodiments, the alloys have a density less than 0.096 $lbs/in^3$.

The following examples are intended to illustrate various aspects of the present invention, and are not intended to limit the scope of the invention.

Example 1

In this example, several billets of Al—Cu—Li alloy wherein the composition is given in Table 2 were cast. Alloy Inv. A, Inv. B, Inv. C, and Inv. D are embodiments of alloys of the present invention. Alloys 2099A, 2099B, 2099C, and 2099D represent alloys falling within the registered Aluminum Association limits of AA2099.

TABLE 2

Results of chemical analysis of billets in weight percent

| Alloy | Cu | Li | Mg | Mn | Zn | Ag | Si | Fe | Zr |
|---|---|---|---|---|---|---|---|---|---|
| Inv. A | 2.89 | 1.54 | 0.20 | 0.04 | 0.01 | — | 0.04 | 0.03 | 0.10 |
| Inv. B | 2.75 | 1.64 | 0.36 | 0.13 | — | — | 0.03 | 0.05 | 0.11 |
| Inv. C | 2.78 | 1.66 | 0.34 | 0.14 | 0.01 | — | 0.03 | 0.04 | 0.10 |
| Inv. D | 2.84 | 1.68 | 0.35 | 0.16 | — | — | 0.03 | 0.05 | 0.11 |
| 2099A | 2.58 | 1.67 | 0.28 | 0.34 | 0.69 | — | 0.02 | 0.04 | 0.10 |
| 2099B | 2.72 | 1.74 | 0.28 | 0.30 | 0.72 | — | 0.03 | 0.05 | 0.11 |
| 2099C | 2.68 | 1.75 | 0.26 | 0.30 | 0.70 | — | 0.03 | 0.05 | 0.11 |
| 2099D | 2.79 | 1.67 | 0.31 | 0.30 | 0.69 | — | 0.03 | 0.03 | 0.10 |

The billets were homogenized according to the practices in Table 3. Billets of alloy Inv. A was homogenized according to practice H1 (835° F.—2 Hours followed by 860° F.—2 Hours followed by 950° F.—12 Hours). Billets of alloy Inv. B were homogenized according to either practice H2 (842° F.—16 Hours followed by 950° F.—10 Hours) or H3 (842° F.—16 Hours followed by 970° F.—20 Hours). Billets of alloys Inv. C and Inv. D were homogenized according to practice H3 (842° F.—16 Hours followed by 970° F.—20 Hours). Billets of alloy 2099A were homogenized according to practice H2. Billets of alloys 2099B and 2099C were homogenized according to practice H3. Billets of alloy 2099D were homogenized according to practice H1.

TABLE 3

Homogenization practices

| ID | Step 1 | Step 2 | Step 3 | Step 4 |
|---|---|---|---|---|
| H1 | 835° F. - 2 Hours | 860° F. - 2 Hours | 950° F. - 12 Hours | — |
| H2 | 842° F. - 16 Hours | 950° F. - 10 Hours | — | — |
| H3 | 842° F. - 16 Hours | 970° F. - 20 Hours | — | — |

The homogenized billets were then subject to hot extrusion to obtain a wrought F-temper section according to FIG. 1. The F-temper extrusions were then solution heat treated, quenched, stretched, and aged according to one of the post plastic deformation processes listed in Table 4. It should be noted that for each post plastic deformation process listed in Table 4 that were was a natural aging period of at least 48 hours between stretching and artificial aging, and that each resulted in a microstructure where at least 75% of the grains were not recrystallized, generally greater than 90%. Herein, test samples are identified as Alloy-Homogenization-Post Plastic Deformation Process. For example, alloy Inv. A homogenized according to practice H1 and processed after being extruded according to process P2 would be identified as Inv. A-H1-P2.

TABLE 4

Post plastic deformation processing parameters

| Process ID | Solution Heat Treatment | Stretch (%) | Age Practice Step 1 | Age Practice Step 2 |
|---|---|---|---|---|
| P1 | 1000° F. | 3 | 305° F. - 48 Hours | — |
| P2 | 1000° F. | 5 | 305° F. - 48 Hours | — |
| P3 | 1000° F. | 3 | 250° F. - 12 Hours | 305° F. - 48 Hours |
| P4 | 1010° F. | 5 | 305° F. - 48 Hours | — |
| P5 | 1010° F. | 3 | 305° F. - 48 Hours | — |
| P6 | 1010° F. | 2.5 | 250° F. - 12 Hours | 305° F. - 48 Hours |

*Each post plastic deformation procedure had at least a 48 hour natural aging period between the stretching and artificial aging steps.

Samples taken at the end of the sections were tested to determine the static mechanical properties (Ultimate tensile strength UTS, Tensile Yield Strength TYS, and elongation at fracture "e"), fracture toughness ($K_Q$), and corrosion resistance. The specimens used for toughness had the following dimensions: B=0.81 in and W=3 in. Exfoliation corrosion testing was done in accordance to ASTM G85—Annex 2 (i.e.—MASTMASSIS testing), and samples were rated according to the ASTM G34 (EXCO) rating system. Intergranular corrosion testing (IGC) was performed according to ASTM G110. Samples were taken from location 1 in FIG. 1 for this example.

Figure 2:
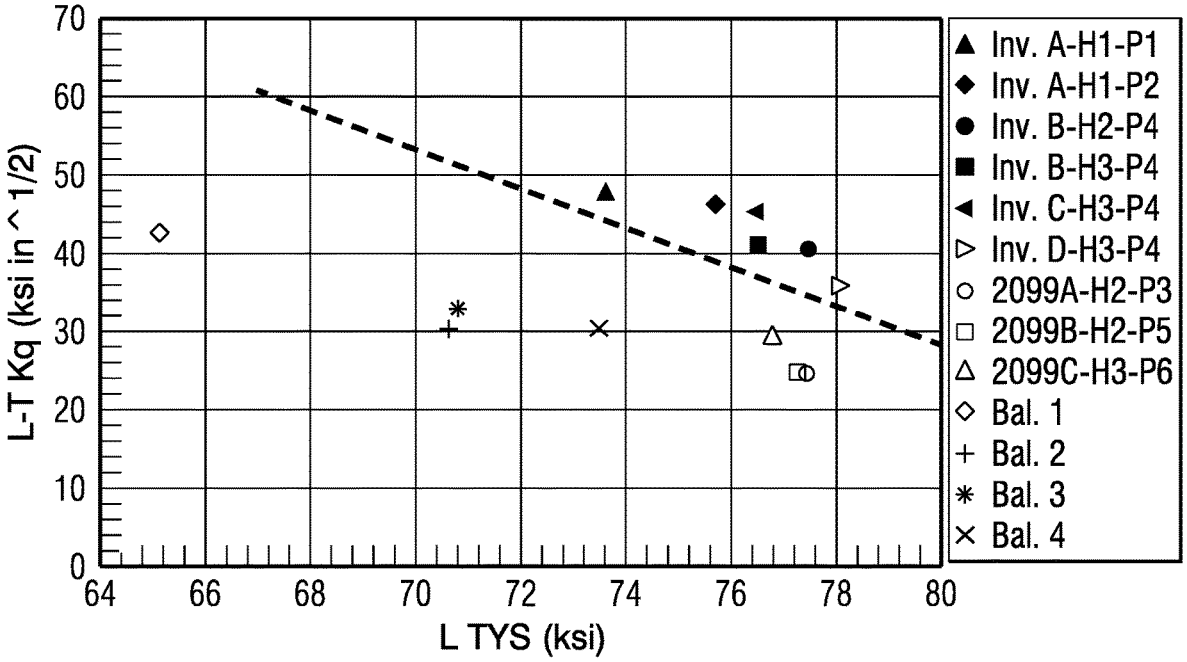
FIG. 2 shows L-T fracture toughness $K_Q$ (ksi √in) versus L tensile yield strength (ksi) for various peak aged products.
Figure 3:
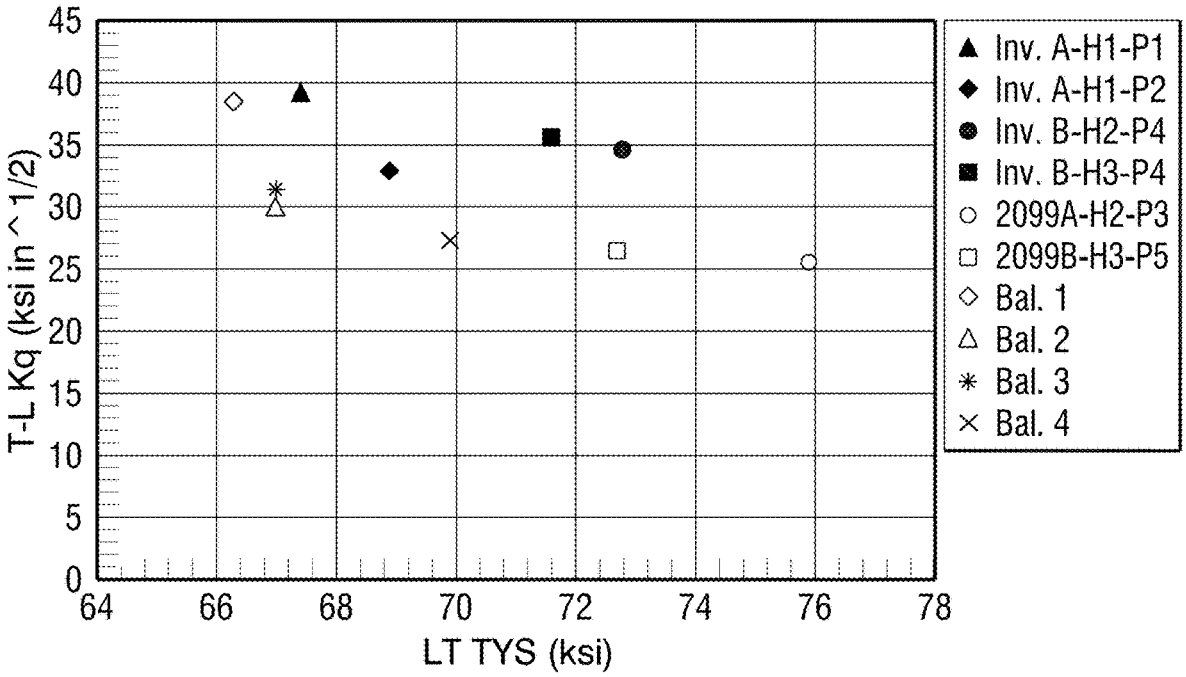
FIG. 3 shows T-L fracture toughness $K_Q$ (ksi √in) versus L-T tensile yield strength (ksi) for various peak aged products.

The average results obtained are given in Table 5, and are plotted in FIGS. 2 and 3.

As shown in FIG. 2, the Inv. A-D alloys listed in Table 5 have fracture toughnesses L-T $K_Q$ of greater than 34 ksi √in and L tensile yield strengths of greater than 72 ksi. As further shown in FIG. 2, the Inv. A-D alloys listed in Table 5 have a combination of L-T fracture toughness $K_Q$ and L tensile yield strength above the dashed line, which corresponds to the equation: L-T $K_Q$>38−2.5*[L TYS−76].

As shown in FIG. 3, the Inv. A-D alloys listed in Table 5 have T-L fracture toughnesses $K_Q$ of greater than 33 ksi √in and L-T tensile yield strengths of greater than 67 ksi. FIG. 3 further shows improved combinations of T-L fracture toughness $K_Q$ and L-T tensile yield strength properties.

TABLE 5

Average mechanical properties obtained from the processing of Example 1

| Alloy | Longitudinal UTS (ksi) | Longitudinal TYS (ksi) | Longitudinal e (%) | Long-Transverse UTS (ksi) | Long-Transverse TYS (ksi) | Long-Transverse e (%) | Fracture Toughness, $K_Q$ L-T (ksi √in) | Fracture Toughness, $K_Q$ T-L (ksi √in) |
|---|---|---|---|---|---|---|---|---|
| Inv. A-H1-P1 | 79.3 | 73.6 | 14.7 | 73.8 | 67.4 | 13.4 | 47.7 | 39.1 |
| Inv. A-H1-P2 | 80.6 | 75.7 | 14.2 | 74.3 | 68.9 | 12.9 | 46.0 | 32.9 |
| Inv. B-H2-P4 | 82.4 | 77.5 | 11.6 | 77.8 | 72.8 | 12.6 | 40.4 | 34.6 |
| Inv. B-H3-P4 | 81.9 | 76.5 | 11.8 | 76.8 | 71.6 | 12.4 | 41.0 | 35.7 |
| Inv. C-H3-P4 | 81.6 | 76.5 | 11.6 | 77.6 | 72.7 | 12.5 | 45.2 | 32.4 |
| Inv. D-H3-P4 | 82.8 | 78.0 | 10.9 | 79.1 | 74.4 | 11.8 | 35.7 | 30.9 |

TABLE 5-continued

| Average mechanical properties obtained from the processing of Example 1 | | | | | | | | |
|---|---|---|---|---|---|---|---|---|
| | | | | | | | Fracture Toughness, $K_Q$ | |
| | Longitudinal | | | Long-Transverse | | | L-T | T-L |
| Alloy | UTS (ksi) | TYS (ksi) | e (%) | UTS (ksi) | TYS (ksi) | e (%) | (ksi √in) | (ksi √in) |
| 2099A-H2-P3 | 82.5 | 77.4 | 9.5 | 80.7 | 75.9 | 9.7 | 24.5 | 25.5 |
| 2099B-H2-P5 | 83.5 | 77.3 | 9.8 | 78.6 | 72.7 | 11.6 | 24.6 | 26.5 |
| 2099C-H3-P6 | 84.1 | 76.8 | 10.2 | 79.2 | 72.3 | 12 | 29.2 | 27.0 |

Additionally, FIG. 2 and FIG. 3 show the example results from Balmuth et al. Low Density Aluminum Lithium Alloys (U.S. Pat. No. 5,234,662) for comparison purposes. The example alloy compositions and processing conditions from Balmuth et al. can be seen in Table 6 and Table 7. It should be noted that the example alloys from Balmuth et al. where rolled to 0.6 in plates from 3 in×7 in×14 in in rolling blocks.

TABLE 6

| Results of chemical analysis of ingots from U.S. Pat. No. 5,234,662 in weight percent | | | | | | | |
|---|---|---|---|---|---|---|---|
| Alloy | Cu | Li | Mg | Mn | Fe | Si | Zr |
| Bal. 1 | 2.99 | 1.61 | 0.005 | 0.26 | 0.06 | 0.04 | 0.11 |
| Bal. 2 | 2.72 | 1.49 | 0.67 | 0.01 | 0.05 | 0.04 | 0.12 |
| Bal. 3 | 2.82 | 1.41 | 1.00 | 0.01 | 0.06 | 0.04 | 0.12 |
| Bal. 4 | 2.75 | 1.29 | 1.47 | 0.01 | 0.06 | 0.04 | 0.12 |

TABLE 7

| Processing conditions for ingots from U. S. Pat. No. 5,234,662 | | | | | |
|---|---|---|---|---|---|
| | Homogenization | | Solution Heat Treat | | Age |
| Alloy | Step 1 | Step 2 | Temperature | Stretch | Practice |
| Bal. 1 | 970° F. - 12 Hours | 1000° F.- 24 Hours | 1000° F. | 5% | 350° F. - 16 Hours |
| Bal. 2 | 950° F. - 16 Hours | 1000° F.- 24 Hours | 1000° F. | 5% | 350° F. - 40 Hours |
| Bal. 3 | 950° F. - 16 Hours | 1000° F.- 24 Hours | 1000° F. | 5% | 350° F. - 40 Hours |
| Bal. 4 | 950° F. - 16 Hours | 1000° F.- 24 Hours | 1000° F. | 5% | 350° F. - 80 Hours |

Figure 4:
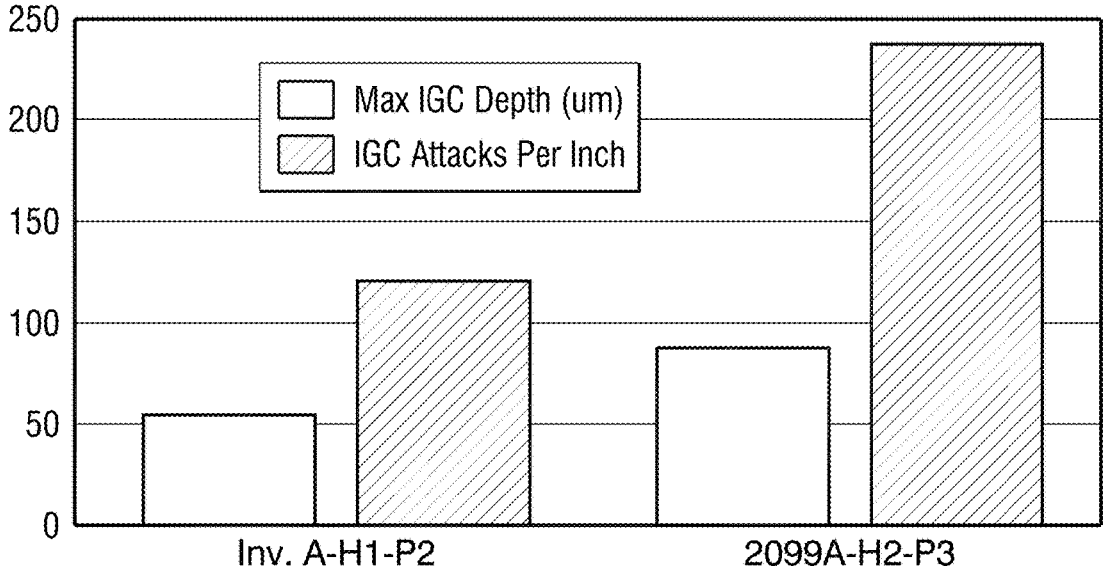
FIG. 4 compares the intergranular corrosion resistance of two peak aged products. Testing was performed according to ASTM G110.

The results of exfoliation corrosion testing according to ASTM G85—Annex 2. (MASTMASSIS) can be seen in Table 8. The results of the IGC testing according to ASTM G110 can be seen in FIG. 4. In order to determine the susceptibility of an alloy to IGC, the maximum depth of attack observed and the frequency of attack was determined and is shown in FIG. 4. The corrosion properties shown in Table 8 and FIG. 4 for the Inv. A-D alloys are desirable and comparable to the corrosion properties of the conventional Zn-containing AA2099 alloys. The Zn-free Inv. A-D alloys also achieve relatively low target densities of approximately 0.095 lbs/in$^3$.

TABLE 8

| Results of ASTM G85 - Annex. 2 (MASTMASSIS) testing | | | | |
|---|---|---|---|---|
| Alloy | Homogenization | Process Procedure | Test Plane | ASTM G34 Rating |
| Inv. A | H1 | P2 | T/10 | EA |
| Inv. B | H2 | P4 | T/10 | EA |
| Inv. C | H3 | P4 | T/10 | EA |
| Inv. D | H3 | P4 | T/10 | EA |
| 2099C | H3 | P6 | T/10 | EA |
| 2099D | H1 | P1 | T/10 | EA |
| 2099D | H1 | P3 | T/10 | EA |

Example 2

In this example, alloys from Example 1 were homogenized and hot extruded into the body shown in FIG. 1. Alloy Inv. A was homogenized according to practice H1 before being hot extruded and undergoing post plastic deformation process P2. Alloy Inv. B was homogenized according to practice H2 before being extruded and undergoing post plastic deformation process P4. Alloy 2099D was homogenized according to practice H1 before being hot extruded. Extrusions of 2099D were then subjected to post plastic deformation processes P1 and P3.

Additionally, billets of alloy 2196A, whose composition falls within the registered Aluminum Association limits for AA2196 and can be seen in Table 9, were cast. The billets were then homogenized according to practice H4 (835° F.—2 Hours followed by 860° F.—6 Hours followed by 950° F.—4 Hours followed by 970° F.—22 Hours) or H5 (835° F.—2 Hours followed by 860° F.—6 Hours followed by 950° F.—4 Hours followed by 970° F.—8 Hours), which can be seen in Table 10. The billets were then hot extruded into the body shown in FIG. 1 before being given post plastic deformation procedure P7, which is given in Table 11.

TABLE 9

| Results of chemical analysis of billets in weight percent | | | | | | | | | |
|---|---|---|---|---|---|---|---|---|---|
| Alloy | Cu | Li | Mg | Mn | Zn | Ag | Si | Fe | Zr |
| 2196A | 2.73 | 1.57 | 0.35 | 0.32 | — | 0.32 | 0.03 | 0.04 | 0.11 |

TABLE 10

| Homogenization practices | | | | |
|---|---|---|---|---|
| ID | Step 1 | Step 2 | Step 3 | Step 4 |
| H4 (G) | 835° F. - 2 Hours | 860° F. - 6 Hours | 950° F. - 4 Hours | 970° F. - 22 Hours |
| H5 (H) | 835° F. - 2 Hours | 860° F. - 6 Hours | 950° F. - 4 Hours | 970° F. - 8 Hours |

TABLE 11

| Post plastic deformation processing parameters | | | | |
|---|---|---|---|---|
| Process | Solution Heat | Stretch | Age Practice | |
| ID | Treatment | (%) | Step 1 | Step 2 |
| P7 | 970° F. | 5 | 305° F. - 48 Hours | — |

Figure 5:
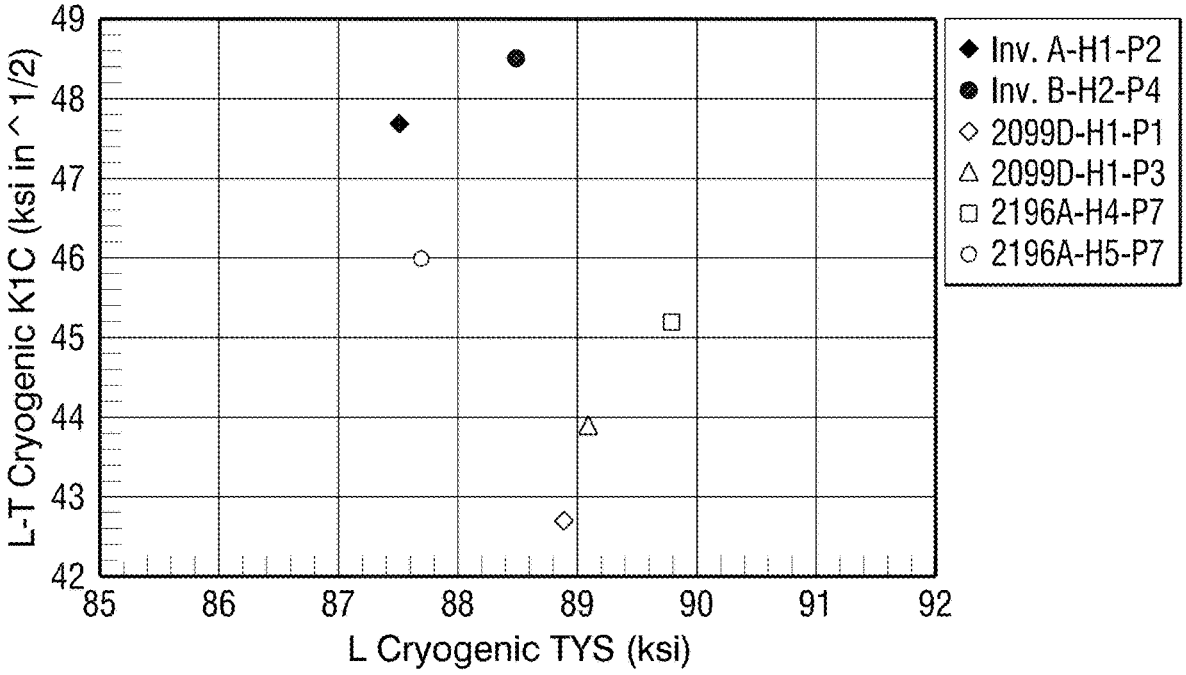
FIG. 5 shows L-T cryogenic fracture toughness (ksi √in) versus L cryogenic tensile yield strength (ksi). All testing was conducted at −320° F.

Samples were taken at the end of the extruded sections from location 1 in FIG. 1. The samples were tested for tensile properties and fracture toughness at cryogenic temperatures herein −320° F. The tensile tests were conducted according to ASTM E8 "Standard Test Methods for Tension Testing of Metallic Materials," and toughness tests were conducted per ASTM E 1820 "Standard Test Method for Measurement of Fracture Toughness." The test results can be seen in Table 12 and FIG. 5.

TABLE 12

Results of cryogenic testing (−320° F.)

| Alloy | L TYS (ksi) | L-T K1C (ksi √in) |
|---|---|---|
| Inv. A-H1-P2 | 87.5 | 47.7 |
| Inv. B-H2-P4 | 88.5 | 48.5 |
| 2099D-H1-P1 | 88.9 | 42.7 |
| 2099D-H1-P3 | 89.1 | 43.9 |
| 2196A-H4-P7 | 89.8 | 45.2 |
| 2196A-H5-P7 | 87.7 | 46.0 |

Example 3

In this example, alloys from Examples 1 and 2 were homogenized and hot extruded into the body shown in FIG. 1. Alloy Inv. A was homogenized according to practice H1 before being hot extruded and subsequently processed according to practice P2. Samples of Alloy Inv. B were homogenized according to either practice H2 or H3 before being hot extruded and subsequently processed according to practice P4. Alloy 2099A was homogenized according to practice H2 before being hot extruded and subsequently processed according to practice P3. Alloy 2099B was also homogenized according to practice H3, but was processed according to practice P5 after being hot extruded. Alloy 2196A was homogenized according to practice H4 before being hot extruded and subsequently processed according to practice P7.

Figure 6:
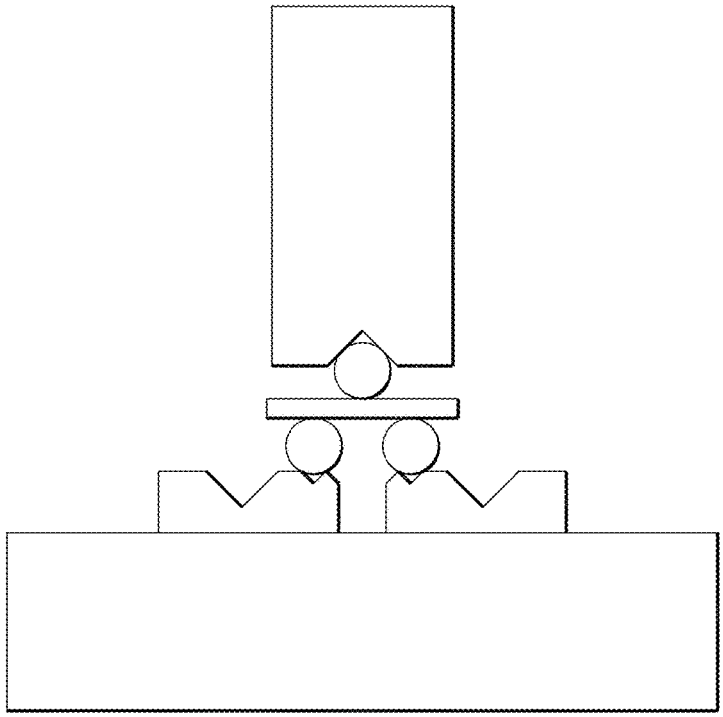
FIG. 6 is a partially schematic front view of a three-point bend fixture that may be used to measure bend displacement of test samples in accordance with the standard DIN EN2563 test procedure.
Figure 7:
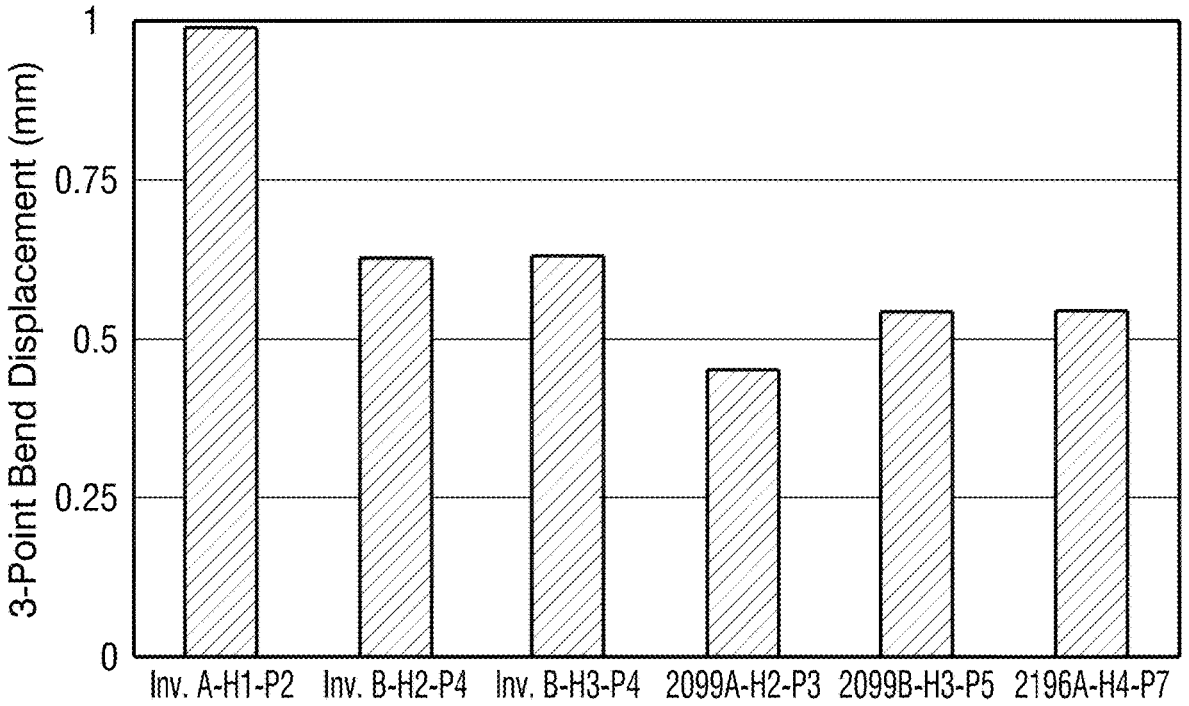
FIG. 7 shows the results of three-point bend testing according to EN2563 on various peak aged products.

Samples measuring 0.787 in×0.394 in×0.079 in (20 mm×10 mm×2 mm) were then taken from location 2 as labeled in FIG. 1 in the S-T direction and then subjected to a standard DIN three-point bend test according to EN2563. The specimens were placed into a three-point bend test apparatus as shown in FIG. 6, and bent as shown in FIG. 1. The specimen taken from location 2 includes a portion of the transition zone located between location 1 and location 2 and therefore the test can be considered off-axis. The distance between the supports, $l_v$, as defined in EN 2563 was 0.3937±0.03937 in (10±1 mm). The test was run at a speed of 0.039 in/min (1 mm/min), and the final displacement at failure was measured. The test results can be seen in Table 13 and FIG. 7.

TABLE 13

Results of three-point bend testing according to EN2563

| Alloy | Three-Point Bend Displacement (mm) |
|---|---|
| Inv. A-H1-P2 | 0.99 |
| Inv. B-H2-P4 | 0.62 |
| Inv. B-H3-P4 | 0.63 |
| 2099A-H2-P3 | 0.45 |
| 2099B-H3-P5 | 0.54 |
| 2196A-H4-P7 | 0.50 |

Example 4

In this example, alloys from Example 1 were homogenized and hot extruded into the body shown in FIG. 1. Alloy Inv. A was homogenized according to practice H1, hot extruded into the body shown in FIG. 1, and then subsequently processed according to process P2. Alloy Inv. C was homogenized according to practice H3, hot extruded into the body shown in FIG. 1, and subsequently processed according to practice P4. Alloy 2099D was homogenized according to practice H1, hot extruded into the body shown in FIG. 1, and subsequently processed according to practice P3.

Figure 8:
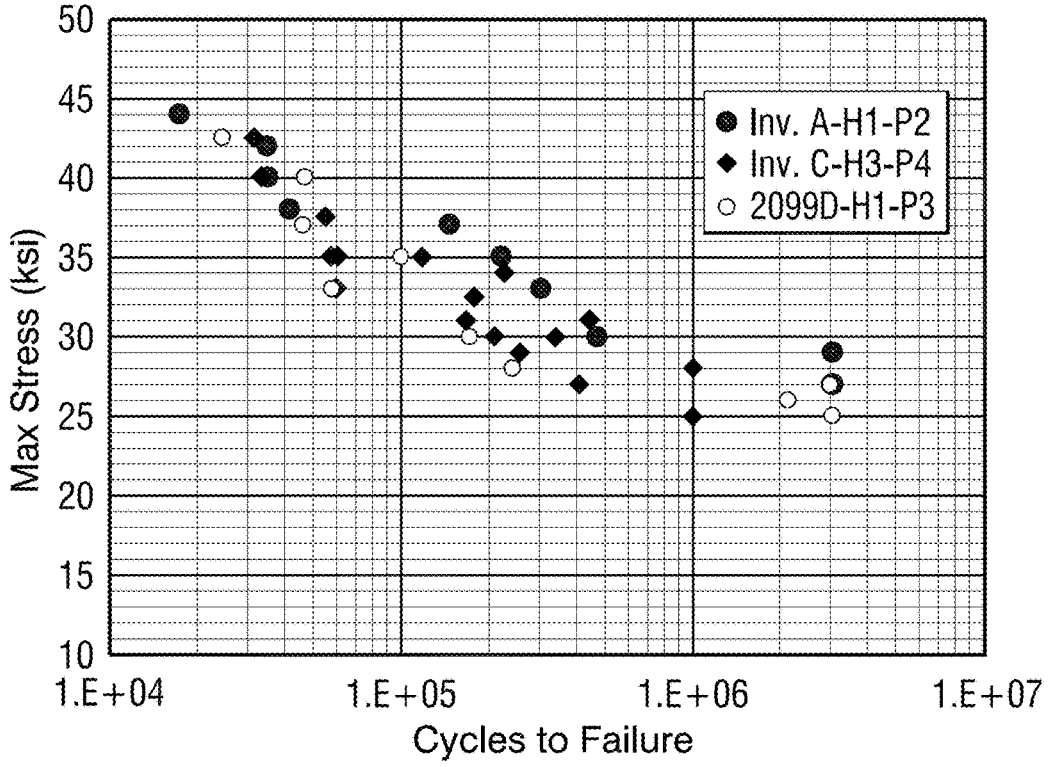
FIG. 8 show S-N curves, max stress (ksi) versus cycles to failure, for various products with arrows indicating runouts.

Fatigue tests were carried out on test pieces with open hole Kt=2.3 T-type specimens with a (minimum load/maximum load) ratio R=0.1 at a frequency of 30 Hz. The tests were carried out in the ambient air of the laboratory. The results are given in Table 14 and shown in FIG. 8.

TABLE 14

Results of S/N fatigue tests

| Inv. A-H1-P2 | | | Inv. C-H3-P4 | | | 2099D-H1-P3 | | |
|---|---|---|---|---|---|---|---|---|
| Maximum Load (ksi) | Cycle to Failure N | Comment | Maximum Load (ksi) | Cycle to Failure N | Comment | Maximum Load (ksi) | Cycle to Failure N | Comment |
| 27 | 2999999 | Runout | 25 | 999999 | Runout | 25 | 2999999 | Runout |
| 29 | 2999999 | Runout | 27 | 407284 | — | 26 | 2117281 | — |
| 30 | 467862 | — | 27 | 407284 | — | 27 | 2952385 | — |
| 33 | 300919 | — | 28 | 999999 | Runout | 28 | 241235 | — |
| 35 | 219529 | — | 29 | 255627 | — | 30 | 171587 | — |
| 37 | 146380 | — | 30 | 208884 | — | 33 | 58401 | — |
| 38 | 41416 | — | 30 | 337748 | — | 35 | 99614 | — |
| 40 | 34968 | — | 31 | 441510 | — | 37 | 46118 | — |
| 42 | 34836 | — | 31 | 167008 | — | 40 | 46767 | — |
| 44 | 17428 | — | 32.5 | 178388 | — | 42.5 | 24376 | — |
| | | | 33 | 59761 | — | | | |
| | | | 34 | 225664 | — | | | |
| | | | 35 | 57905 | — | | | |
| | | | 35 | 117908 | — | | | |
| | | | 35 | 60491 | — | | | |
| | | | 37.5 | 55063 | — | | | |
| | | | 40 | 33213 | — | | | |
| | | | 42.5 | 31448 | — | | | |

Example 5

In this example, alloys from Examples 1 and 2 were homogenized and hot extruded into the body in FIG. 1. Alloys Inv. C and 2099C were homogenized according to practice H3. Billets of alloy 2196A were homogenized according to practice H4 or H5. Samples from test location 1 from each alloy where then subjected to one of the post plastic deformation processes in Table 15 before being tested for tensile strength.

TABLE 15

Post plastic deformation processing parameters

| Process ID | Solution Heat Treatment | Stretch (%) | Age Practice Step 1 | Age Practice Step 2 |
|---|---|---|---|---|
| P8 | 950° F. | 5 | 305° F. - 48 Hours | — |
| P9 | 975° F. | 5 | 305° F. - 48 Hours | — |
| P10 | 1010° F. | 3 | 305° F. - 48 Hours | — |
| P11 | 1010° F. | 7 | 305° F. - 48 Hours | — |
| P12 | 1010° F. | 9 | 305° F. - 48 Hours | — |
| P13 | 1010° F. | 3 | 250° F. - 12 Hours | 305° F. - 48 Hours |
| P14 | 1010° F. | 5 | 250° F. - 12 Hours | 305° F. - 48 Hours |

Figure 9:
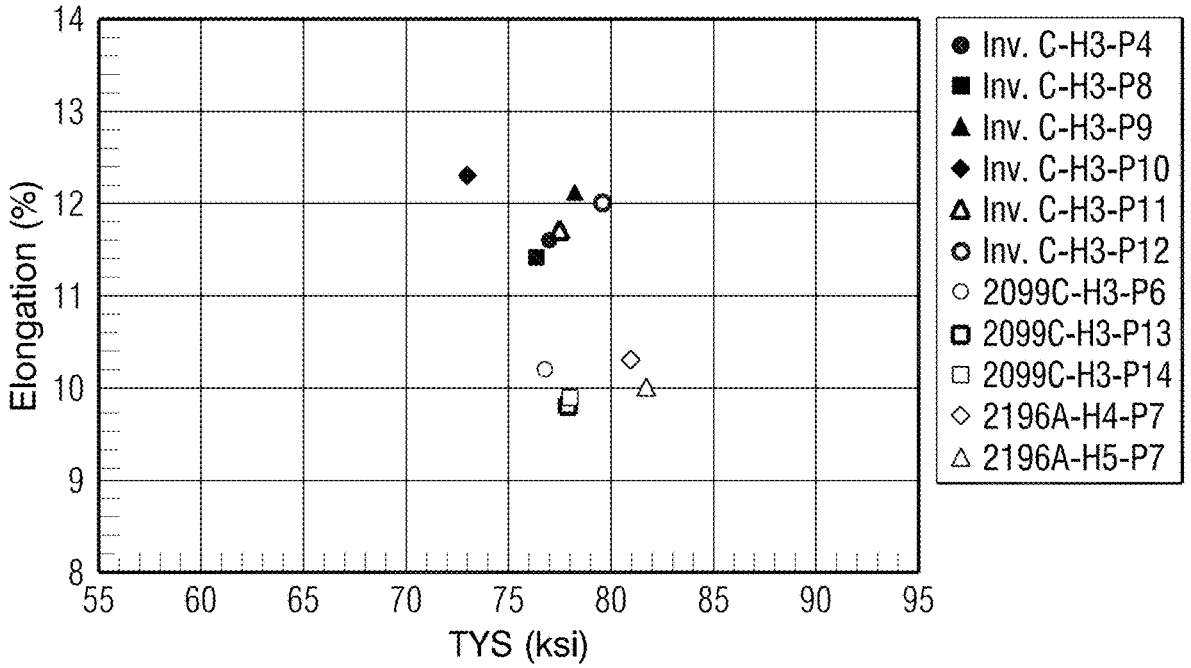
FIG. 9 shows L elongation (%) versus L tensile yield strength (ksi) for various samples produced by different solution heat treatment and stretching combinations.

Tensile testing was performed according to ASTM B557—Standard Test Methods for Tension Testing Wrought and Cast Aluminum- and Magnesium-Alloy Products. The results can be seen in Table 16 and FIG. 9.

TABLE 16

Results of tensile testing from Example 5

| Alloy | UTS (ksi) | TYS (ksi) | Elongation (%) |
|---|---|---|---|
| Inv. C-H3-P8 | 81.7 | 76.4 | 11.4 |
| Inv. C-H3-P9 | 83.0 | 78.2 | 12.1 |
| Inv. C-H3-P4 | 82.3 | 77.0 | 11.6 |
| Inv. C-H3-P10 | 80.5 | 73.0 | 12.3 |
| Inv. C-H3-P11 | 82.5 | 77.5 | 11.7 |
| Inv. C-H3-P12 | 83.8 | 79.6 | 12.0 |
| 2099C-H3-P6 | 84.1 | 76.8 | 10.2 |
| 2099C-H3-P13 | 83.9 | 77.9 | 9.8 |
| 2099C-H3-P14 | 83.7 | 78.0 | 9.9 |
| 2196A-H4-P7 | 84.9 | 81.0 | 10.3 |
| 2196A-H5-P7 | 85.6 | 81.7 | 10.0 |

Example 6

In this example, artificial aging curves from the T3 temper were developed. Alloy Inv. C from Example 1 was homogenized and hot extruded in the body shown in FIG. 1. Alloy Inv. C-H3 was then solution heat treated at 1010° F. before being quenched and stretched 5% before being allowed to naturally age for at least 72 hours so a T3 temper could be established.

Figure 10:
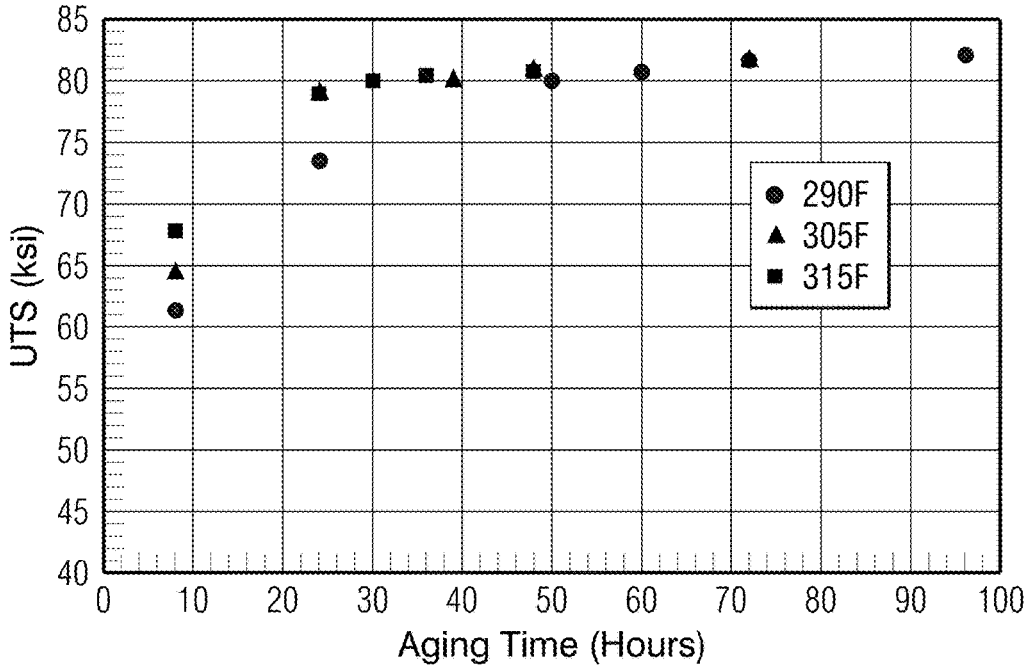
FIG. 10 shows L ultimate tensile strength (ksi) versus aging time (hours) for various samples.
Figure 11:
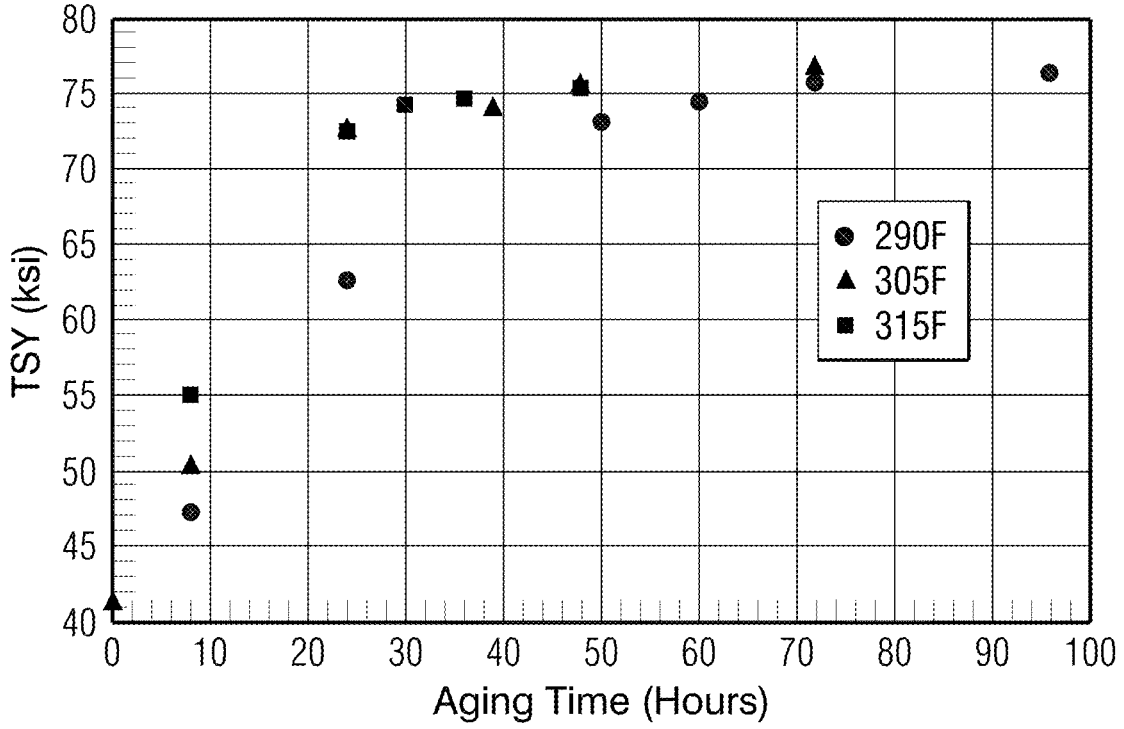
FIG. 11 shows L tensile yield strength (ksi) versus aging time (hours) for various samples.
Figure 12:
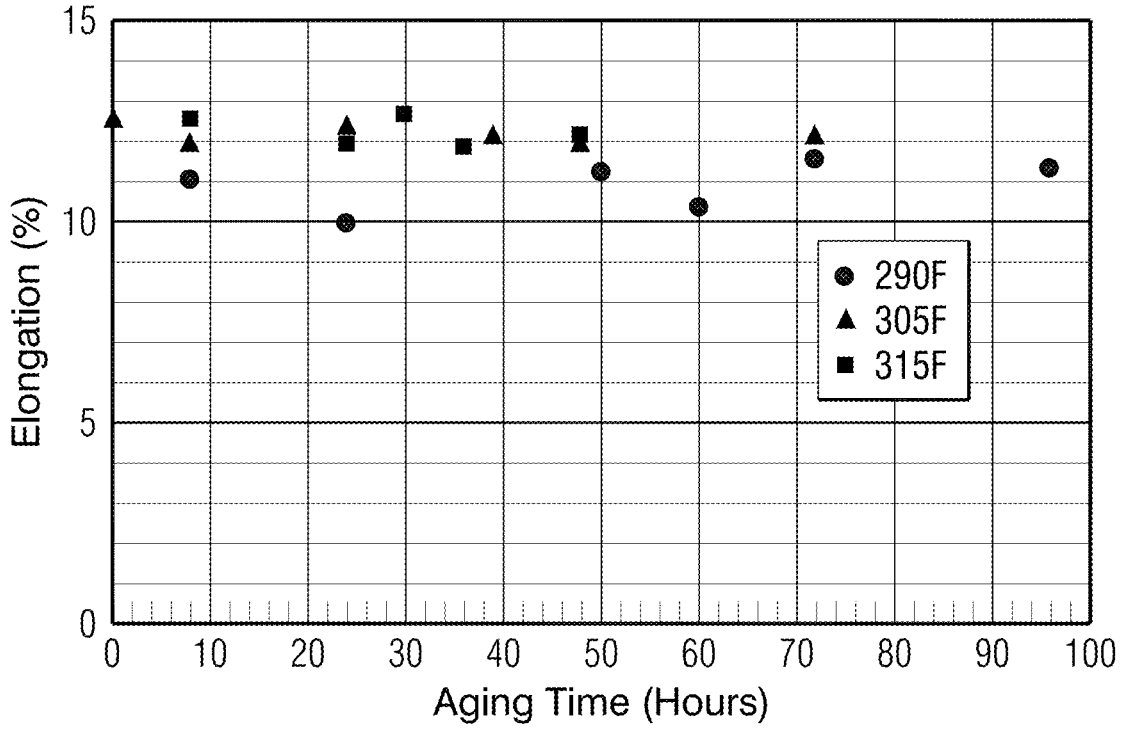
FIG. 12 shows L elongation (%) versus aging time (hours) for various samples.
Figure 13:
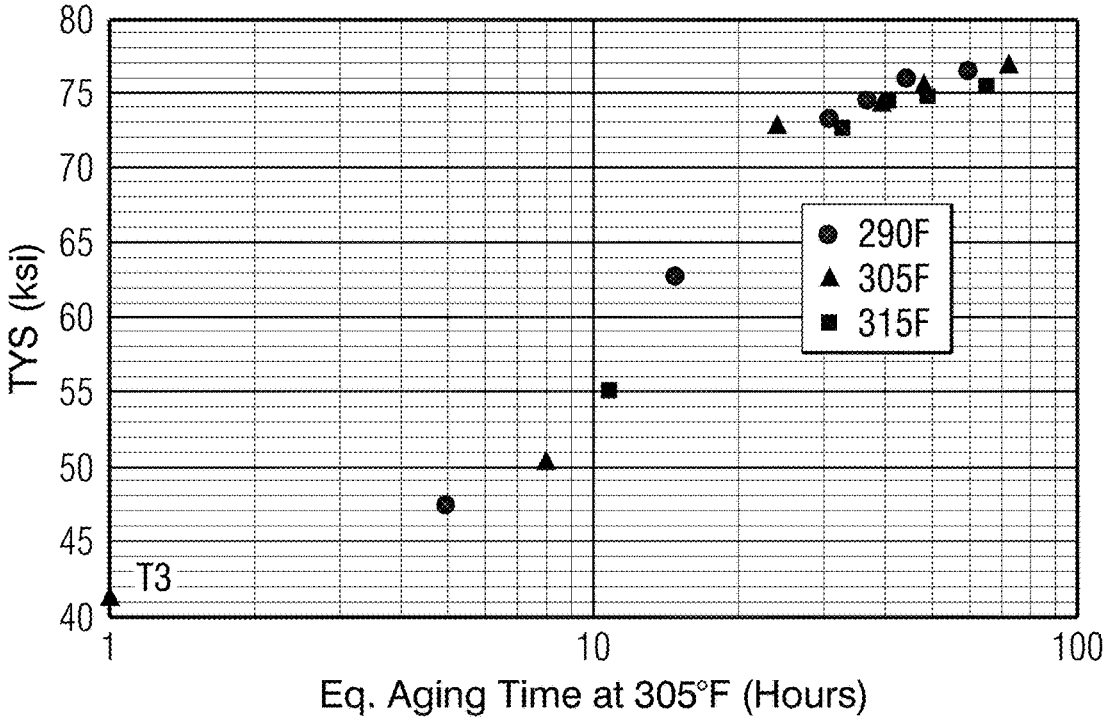
FIG. 13 shows L tensile yield strength (ksi) versus equivalent aging time at 305° F. (hours) for various samples.
Figure 14:
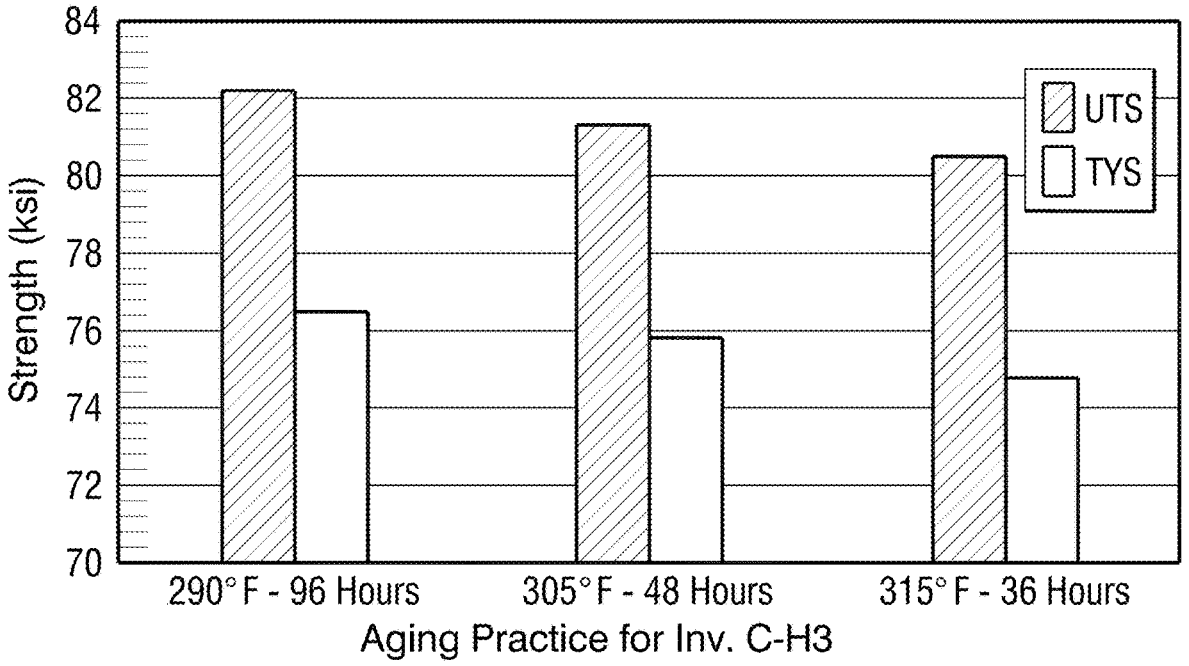
FIG. 14 shows L tensile strengths (ksi) for Inv. C-K at various peak aged conditions.

Samples of alloy Inv. C-H2-T3 were aged at 290° F., 305° F., and 315° F. for various times between 0 and 100 hours before being tensile tested. The results of the tensile test can be seen in Table 17 and FIG. 10-12. The equivalent time at 305° F. for each of the aging curves was calculated using a Q=85.271 kJ/mol, which was developed per the Augis and Bennett expression for determining the activation energy of the aging process with various heating rates as described in J. A. Augis and J. E. Bennett "Calculation of the Avrami parameters for heterogeneous solid state reactions using a modification of the Kissinger method" Journal of Thermal Analysis, 1978, v. 13, p. 283-292, and V. S. Aigbodion "Quantitative interpretation of differential scanning calorimetry heat effect in A2009 aluminum alloy," The Pacific Journal of Science and Technology, 2013, v. 14, p. 16-25. FIG. 13 displays TYS (ksi) versus equivalent aging time at 305° F. It should be noted that the 1 hour at 305° F. point is the T3 condition, and was set to 305° F.—1 hour for graphical purposes. It can be seen from FIG. 13 that the peak-aged condition for each aging practices is reached at roughly the same equivalent aging time. The results of tensile tests on the various peak aged conditions can be seen in FIG. 14.

TABLE 17

Results of tensile testing obtained from the processing of Example 6

| Alloy | Aging Temperature | Aging Time (Hrs) | UTS (ksi) | TYS (ksi) | Elongation (%) |
|---|---|---|---|---|---|
| Inv. C-H3 | T3 | NA | 52.5 | 41.3 | 12.6 |
| Inv. C-H3 | 290° F. | 8 | 61.4 | 47.3 | 11.1 |
| Inv. C-H3 | 290° F. | 24 | 73.6 | 62.8 | 10.0 |
| Inv. C-H3 | 290° F. | 50 | 80.2 | 73.3 | 11.3 |
| Inv. C-H3 | 290° F. | 60 | 80.8 | 74.6 | 10.1 |
| Inv. C-H3 | 290° F. | 72 | 81.7 | 75.9 | 11.6 |
| Inv. C-H3 | 290° F. | 96 | 82.2 | 76.5 | 11.4 |
| Inv. C-H3 | 305° F. | 8 | 64.5 | 50.4 | 12.0 |
| Inv. C-H3 | 305° F. | 24 | 79.3 | 72.9 | 12.4 |
| Inv. C-H3 | 305° F. | 39 | 80.2 | 74.3 | 12.2 |
| Inv. C-H3 | 305° F. | 48 | 81.3 | 75.8 | 12.0 |
| Inv. C-H3 | 305° F. | 72 | 82.0 | 76.9 | 12.2 |
| Inv. C-H3 | 315° F. | 8 | 67.9 | 55.1 | 12.6 |
| Inv. C-H3 | 315° F. | 24 | 79 | 72.6 | 12.0 |
| Inv. C-H3 | 315° F. | 30 | 80.1 | 74.4 | 12.7 |
| Inv. C-H3 | 315° F. | 36 | 80.5 | 74.8 | 11.9 |
| Inv. C-H3 | 315° F. | 48 | 80.9 | 75.5 | 12.2 |

Example 7

In this example, Alloys Inv. A, Inv. B, 2099B, and 2099C from Example 1 were homogenized and hot extruded into the body in FIG. 1. Alloy Inv. A was then processed according to post plastic deformation process P15 (see Table 18), Alloy Inv. B was then processed according to post plastic deformation process P16. Alloys 2099B and 2099C were then processed according to either post plastic deformation process P17 or P18. It should be noted that each post plastic deformation process contained a natural aging step of at least 48 hours between stretching and artificial aging. It should be appreciated that 2099B-H3-P17 and 2099C-H3-P18 fall within the AMS specification (AMS 4459) for AA2099-T81.

TABLE 18

Post plastic deformation processing parameters

| Process ID | Solution Heat Treatment | Stretch (%) | Age Practice Step 1 | Age Practice Step 2 |
|---|---|---|---|---|
| P15 | 1000° F. | 5 | 305° F. - 17.5 Hours | — |

TABLE 18-continued

| Post plastic deformation processing parameters | | | | |
|---|---|---|---|---|
| Process | Solution Heat | | Age Practice | |
| ID | Treatment | Stretch (%) | Step 1 | Step 2 |
| P16 | 1010° F. | 5 | 305° F. - 17.5 Hours | — |

TABLE 18-continued

| Post plastic deformation processing parameters | | | | |
|---|---|---|---|---|
| Process | Solution Heat | | Age Practice | |
| ID | Treatment | Stretch (%) | Step 1 | Step 2 |
| P17 | 1010° F. | 3 | 250° F. - 10 Hours | 305° F. - 17 Hours |
| P18 | 1010° F. | 2.5 | 250° F. - 10 Hours | 305° F. - 17 Hours |

Figure 15:
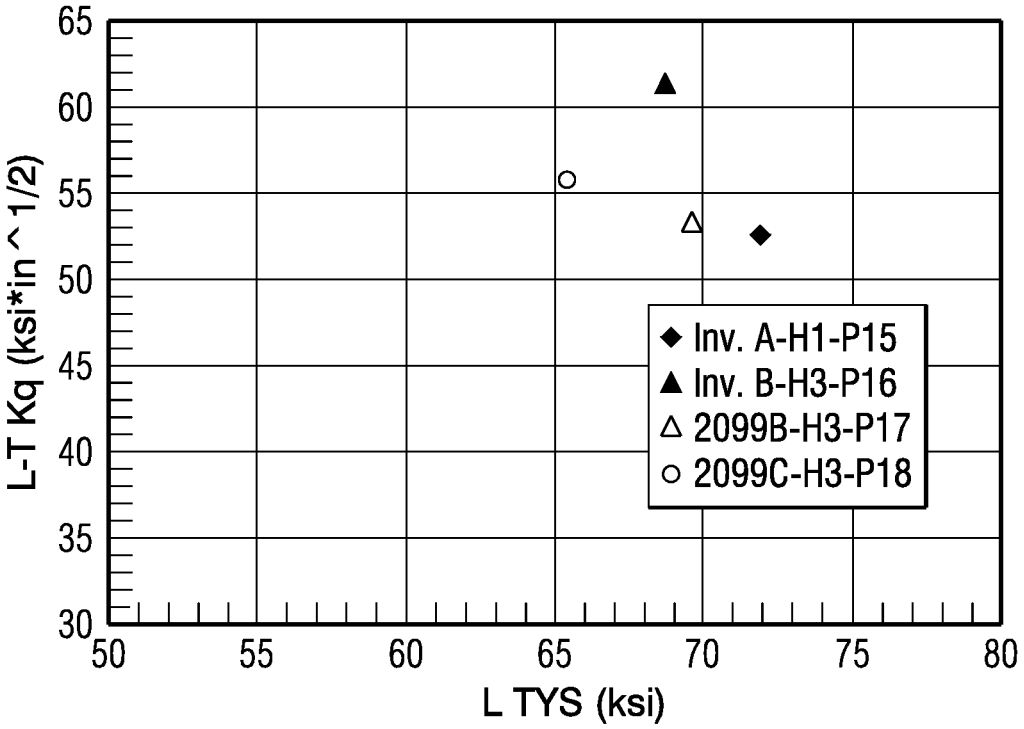
FIG. 15 shows L-T fracture toughness (ksi √in) versus L tensile yield strength (ksi) for various under-aged products.

Samples taken at the end of the sections were tested to determine the static mechanical properties (Ultimate tensile strength UTS, Tensile Yield Strength TYS, and elongation at fracture e) and fracture toughness ($K_Q$) at test location 1. The specimens used for toughness had the following dimensions: B=0.81 in and W=3 in. The test results can be seen in Table 19 and FIG. 15.

TABLE 19

| | Longitudinal | | | Fracture Toughness $K_Q$ |
|---|---|---|---|---|
| Alloy | UTS (ksi) | TYS (ksi) | e (%) | L-T (ksi √in) |
| Inv. A-H1-P15 | 77.8 | 71.9 | 13.5 | 52.6 |
| Inv. B-H3-P16 | 76.6 | 68.7 | 10.4 | 61.3 |
| 2099B-H3-P17 | 79.4 | 69.6 | 10.3 | 53.3 |
| 2099C-H3-P18 | 77.9 | 65.4 | 10.2 | 55.8 |

Figure 16:
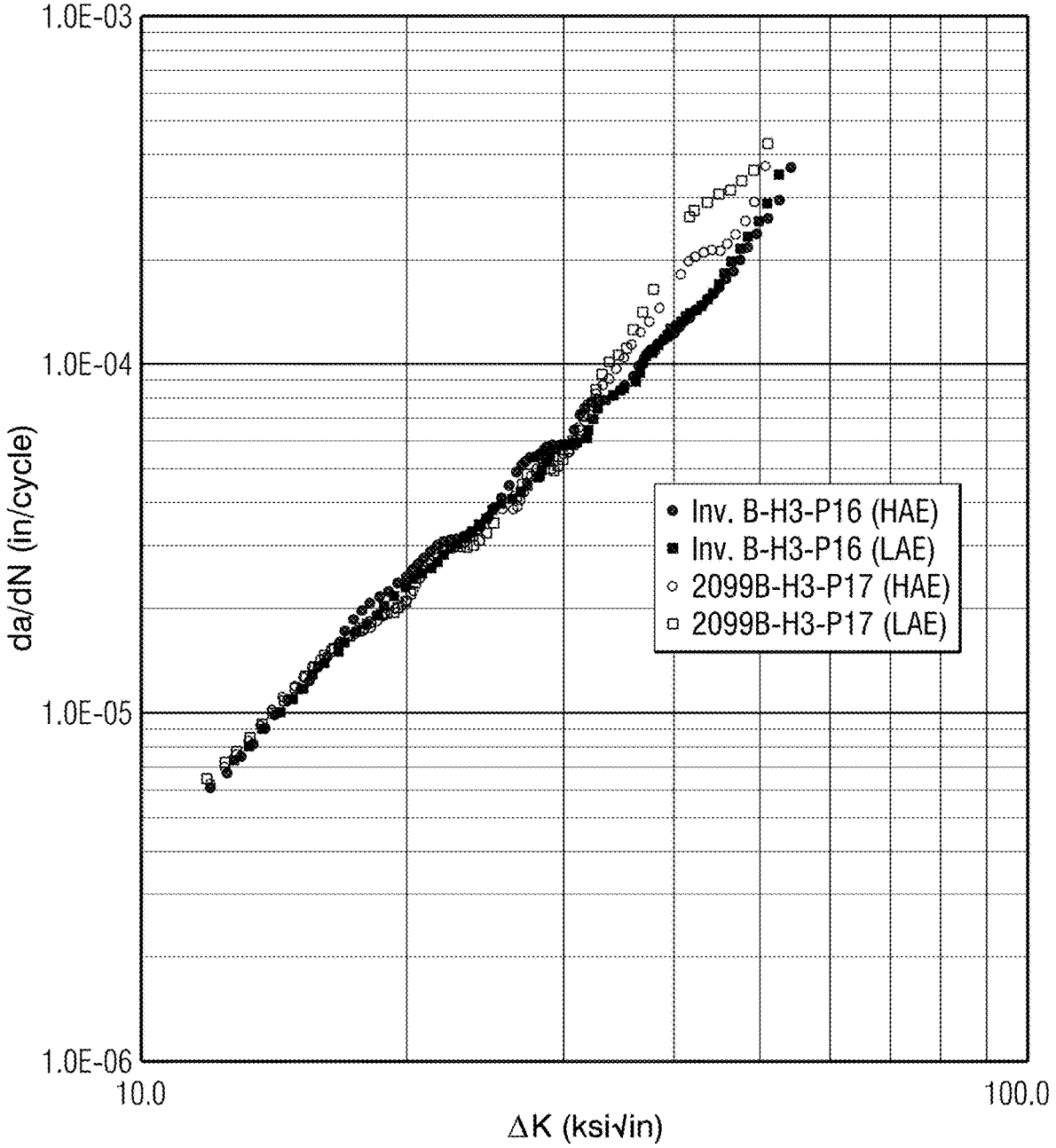
FIG. 16 shows fatigue crack growth rate (FCGR), da/DN (in/cycle) versus Δk (ksi √in), results for various under-aged products.

Samples of Inv. B-H3-P16 and 2099B-H3-P17 also taken from the rear of the sections were then tested for fatigue crack growth rate in both a lab air environment (LAE) with a relative humidity level between 26-42% and humid air environment (HAE) with a relative humidity greater than 90%. CC(t) center crack tension specimens with a nominal width (W) of 4 in and a thickness (B)=0.2 in were used. The test results can be seen in FIG. 16, which shows da/dn (inches/cycle) versus ΔK (ksi √in).

Example 8

In this example, billets of Inv. E and 2196B, whose compositions can be seen in Table 20, were cast. It should be noted that 2196B falls within the registered limits of AA2196. Inv. E was homogenized according to H3, and 2196B was homogenized according to practice H6 (900° F.—8 Hours followed by 950° F.—24 Hours), which can be seen in Table 21. The homogenized billets were subject to hot extrusion to obtain wrought F-temper sections according to FIG. 17. It should be noted that each extrusion was performed in such a way to produce a largely un-recrystallized grain structure following solution heat treatment. Samples were taken from the extruded sections at location 1 in the longitudinal direction and subjected to various post plastic deformation processes given in Table 22. It will be appreciated that 2196B-H6-P19 falls within the limits of AMS 4416, which covers AA2196-T8511.

TABLE 20

| Results of chemical analysis of billets in weight percent | | | | | | | | | | |
|---|---|---|---|---|---|---|---|---|---|---|
| Alloy | Cu | Li | Mg | Mn | Zn | Ag | Si | Fe | Zr | Ti |
| Inv. E | 2.78 | 1.65 | 0.34 | 0.14 | 0.00 | 0.00 | 0.03 | 0.04 | 0.11 | 0.02 |
| 2196B | 2.91 | 1.87 | 0.39 | 0.27 | 0.02 | 0.28 | 0.03 | 0.06 | 0.11 | 0.04 |

TABLE 21

| Homogenization practices | | | | |
|---|---|---|---|---|
| ID | Step 1 | Step 2 | Step 3 | Step 4 |
| H6(N) | 900° F. - 8 Hours | 950° F. - 24 Hours | — | — |

TABLE 22

| Post plastic deformation processing parameters | | | | |
|---|---|---|---|---|
| Process ID | Solution Heat Treatment | Natural Age Prior to Stretch | Stretch (%) | Age Practice |
| P19 | 940° F. | <1 Hour | 2.5 | 305° F. - 48 Hours |
| P20 | 1,010° F. | <1 Hour | 2.75 | 305° F. - 48 Hours |
| P21 | 1,010° F. | <1 Hour | 5.25 | 305° F. - 48 Hours |
| P22 | 1,010° F. | 12 Hours | 2.5 | 305° F. - 48 Hours |
| P23 | 1,010° F. | 24 Hours | 4.8 | 305° F. - 48 Hours |

Figure 18:
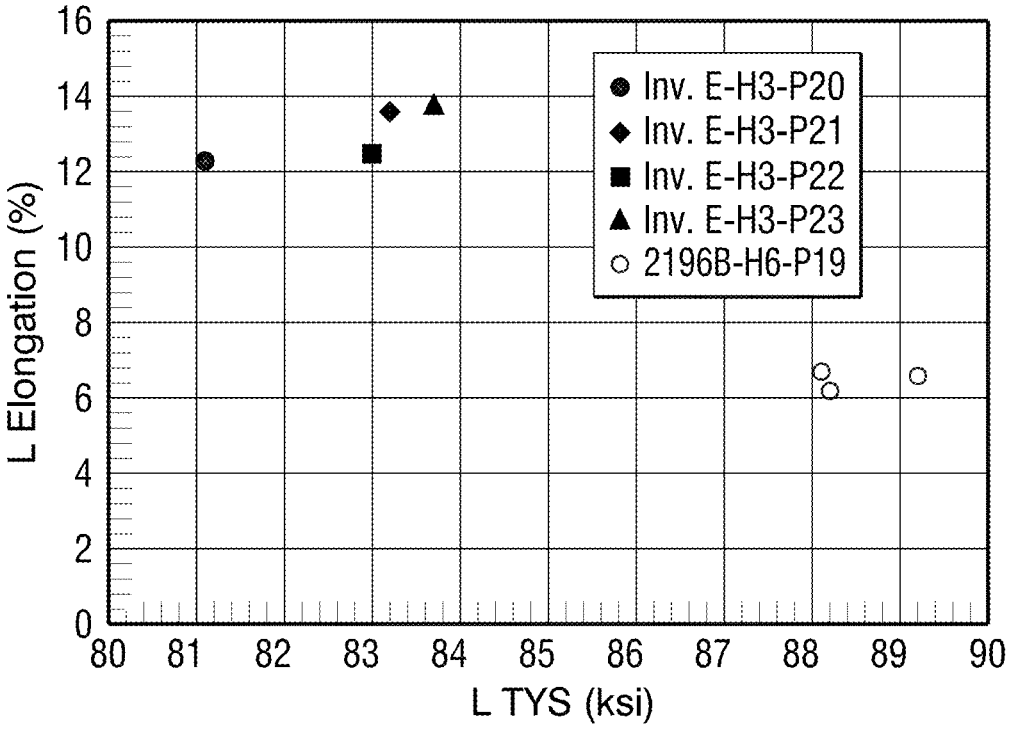
FIG. 18 shows L elongation (%) versus L tensile yield strength (ksi) for various samples produced by different solution heat treatment, natural aging, and stretching combinations.

The samples were then tested for tensile strength according to ASTM B557. The results of these test can be seen in Table 23 and FIG. 18.

TABLE 23

| Mechanical properties obtained from the processing of Example 8 | | | |
|---|---|---|---|
| Alloy | UTS (ksi) | TYS (ksi) | Elongation (%) |
| 2196B-H6-P19 | 90.0 | 88.1 | 6.7 |
| 2196B-H6-P19 | 91.2 | 89.2 | 6.6 |
| 2196B-H6-P19 | 90.1 | 88.2 | 6.2 |
| Inv. E-H3-P20 | 85.4 | 81.1 | 12.3 |
| Inv. E-H3-P21 | 86.4 | 83.2 | 13.6 |
| Inv. E-H3-P22 | 86.5 | 83.0 | 12.5 |
| Inv. E-H3-P23 | 86.8 | 83.7 | 13.8 |

Example 9

In this example, a billet of Inv. D was homogenized according to practice H3 (842° F.—16 Hours followed 970° F.—20 Hours). The homogenized billet was then hot extruded to obtain an F-temper section according to FIG. 19. The F-temper extrusion was then solution heat treated, quenched, stretched, and aged according to post plastic deformation procedure P4, as given in Table 4. The samples were then tested at location 1 in FIG. 19 for tensile strength according to ASTM B557. The results can be seen in Table 24.

TABLE 24

Mechanical properties obtained by the processing of Example 9

| | Longitudinal | | | Long-Transverse | | |
|---|---|---|---|---|---|---|
| Alloy | UTS (ksi) | TYS (ksi) | Elongation (%) | UTS (ksi) | TYS (ksi) | Elongation (%) |
| Inv. D-H3-P4 | 82.8 | 78.8 | 11.0 | 78.9 | 74.5 | 11.7 |

Figure 20:
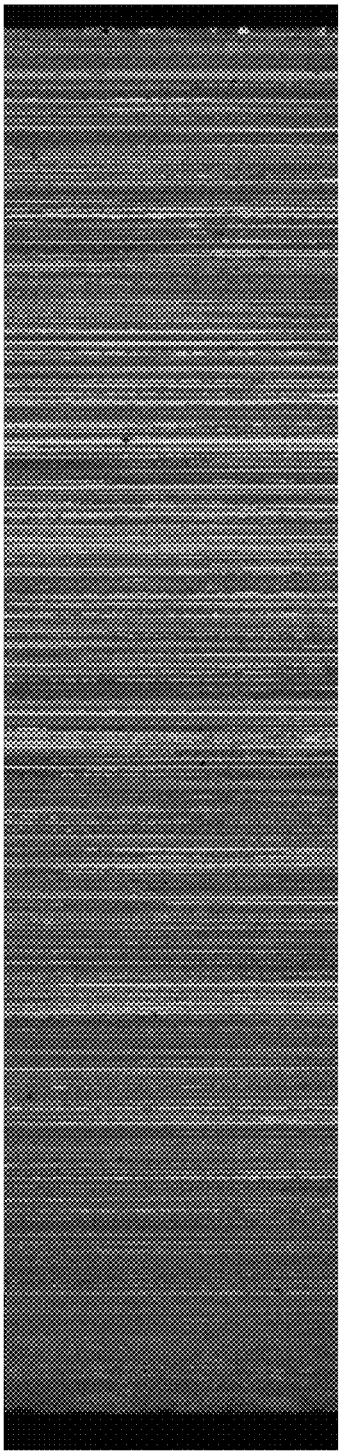
FIG. 20 is an L-S micrograph of the extrusion shown in FIG. 19.

Additionally, alloy Inv. D-H3-P4 was sectioned for metallographic evaluation at location 1 in the L-S orientation as known to those skilled in the art. The metallographic sample was polished and etched using Barker's Reagent (4-5 mL $HBF_4$, 200 mL $H_2O$) using techniques known to those skilled in the art before being analyzed via optical microscopy. A micrograph of the extruded section can be seen in FIG. 20.

For purposes of this detailed description, it is to be understood that the invention may assume various alternative variations and step sequences, except where expressly specified to the contrary. Moreover, other than in any operating examples, or where otherwise indicated, all numbers expressing, for example, quantities of ingredients used in the specification and claims are to be understood as being modified in all instances by the term "about". Accordingly, unless indicated to the contrary, the numerical parameters set forth in the foregoing specification and attached claims are approximations that may vary depending upon the desired properties to be obtained by the present invention. At the very least, and not as an attempt to limit the application of the doctrine of equivalents to the scope of the claims, each numerical parameter should at least be construed in light of the number of reported significant digits and by applying ordinary rounding techniques.

Notwithstanding that the numerical ranges and parameters setting forth the broad scope of the invention are approximations, the numerical values set forth in the specific examples are reported as precisely as possible. Any numerical value, however, inherently contains certain errors necessarily resulting from the standard variation found in their respective testing measurements.

Also, it should be understood that any numerical range recited herein is intended to include all sub-ranges subsumed therein. For example, a range of "1 to 10" is intended to include all sub-ranges between (and including) the recited minimum value of 1 and the recited maximum value of 10, that is, having a minimum value equal to or greater than 1 and a maximum value of equal to or less than 10.

In this application, the use of the singular includes the plural and plural encompasses singular, unless specifically stated otherwise. In addition, in this application, the use of "or" means "and/or" unless specifically stated otherwise, even though "and/or" may be explicitly used in certain instances.

Whereas particular embodiments of this invention have been described above for purposes of illustration, it will be evident to those skilled in the art that numerous variations of the details of the present invention may be made without departing from the invention as defined in the appended claims.

What is claimed is:

1. An extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product comprises ≤25% recrystallized grains, and has a L-T fracture toughness $K_Q$ of at least 34 ksi √in and a L tensile yield strength of at least 72 ksi.

2. The extruded aluminum alloy product of claim 1, further comprising a combination of L-T fracture toughness $K_Q$ (ksi √in) and a L tensile yield strength (ksi) corresponding to the following equation:

$$L\text{-}T\ K_Q > 38 - 2.5 * [L\ \text{TYS} - 76].$$

3. The extruded aluminum alloy product of claim 1, comprising from, in weight percent, 2.8-3.0 Cu, 1.4-1.6 Li, 0.1-0.25 Mg, 0.05 max Mn, 0.2 max Zn, 0.05 max Ag, 0.05 max Si, 0.07 max Fe, 0.09-0.13 Zr, 0-0.06 Ti, and the balance Al and incidental impurities.

4. The extruded aluminum alloy product of claim 1, comprising from, in weight percent, 2.7-2.9 Cu, 1.55-1.75 Li, 0.3-0.4 Mg, 0.1-0.2 Mn, 0.2 max Zn, 0.05 max Ag, 0.05 max Si, 0.07 max Fe, 0.09-0.13 Zr, 0-0.06 Ti, and the balance Al and incidental impurities.

5. The extruded aluminum alloy product of claim 1, wherein the extruded aluminum alloy product is substantially free of Ag.

6. The extruded aluminum alloy product of claim 1, wherein the extruded aluminum product is substantially free of Zn.

7. The extruded aluminum alloy product of claim 1, wherein the extruded aluminum product has a first section having a higher aspect ratio than a second section, and at least one transition zone extending into the first and second sections.

8. The extruded aluminum alloy product of claim 7, wherein the extruded aluminum alloy product has an off-axis OA three-point bend displacement d measured at the transition zone of greater than 0.55 mm as measured per EN 2563.

9. The extruded aluminum alloy product of claim 1, wherein the extruded aluminum alloy product has a density of less than 0.096 lbs/in$^3$.

10. The extruded aluminum alloy product of claim 1, wherein the L-T $K_Q$ is greater than 40 ksi √in and the L TYS is greater than 75 ksi.

11. The extruded aluminum alloy product of claim 1, wherein extruded aluminum alloy product has a T-L fracture toughness $K_Q$ of at least 33 ksi √in and a tensile yield strength L-T TYS of at least 67 ksi.

12. The extruded aluminum alloy product of claim 1, wherein the extruded aluminum alloy product has a cryogenic L-T fracture toughness $K_Q$ of greater than 47 ksi √in.

13. The extruded aluminum alloy product of claim 1, wherein the extruded aluminum alloy product has an exfoliation corrosion rating of at least EB.

14. The extruded aluminum alloy product of claim 1, wherein the extruded aluminum alloy product is solution heat treated, stretched and artificially aged.

15. An extruded aluminum alloy product comprising from, in weight percent, 2.6-3.0 Cu, 1.4-1.75 Li, 0.1-0.45 Mg, 0-0.25 Mn, 0.2 max Zn, 0.05 max Ag, 0.1 max Si, 0.12 max Fe, 0.05-0.15 Zr, 0-0.1 Ti, and the balance Al and incidental impurities, wherein the extruded aluminum alloy product comprises ≤25% recrystallized grains, and has a T-L fracture toughness $K_Q$ of at least 33 ksi √in and a tensile yield strength L-T of at least 67 ksi.

16. The extruded aluminum alloy of claim 15, comprising from, in weight percent, 2.8-3.0 Cu, 1.4-1.6 Li, 0.1-0.25 Mg, 0.05 max Mn, 0.2 max Zn, 0.05 max Ag, 0.05 max Si, 0.07 max Fe, 0.09-0.13 Zr, 0-0.06 Ti, and the balance Al and incidental impurities.

17. The extruded aluminum alloy of claim 15, comprising from, in weight percent, 2.7-2.9 Cu, 1.55-1.75 Li, 0.3-0.4 Mg, 0.1-0.2 Mn, 0.2 max Zn, 0.05 max Ag, 0.05 max Si, 0.07 max Fe, 0.09-0.13 Zr, 0-0.06 Ti, and the balance Al and incidental impurities.

18. The extruded aluminum alloy product of claim 15, wherein the extruded aluminum alloy product has a L-T fracture toughness $K_Q$ of at least 34 ksi √in and a tensile yield strength L TYS of at least 72 ksi.

19. An extruded aluminum alloy product comprising from, in weight percent, 2.8-3.0 Cu, 1.4-1.6 Li, 0.1-0.25 Mg, 0.05 max Mn, 0.2 max Zn, 0.05 max Ag, 0.05 max Si, 0.07 max Fe, 0.09-0.13 Zr, 0-0.06 Ti, and the balance Al and incidental impurities, wherein the extruded aluminum alloy product comprises ≤25% recrystallized grains, and has a L-T fracture toughness $K_Q$ of greater than 42 ksi √in.

20. The extruded aluminum alloy product of claim 19, comprising from, in weight percent, 2.8-3.0 Cu, 1.4-1.6 Li, 0.15-0.25 Mg, 0.05 max Mn, 0.05 max Zn, 0.05 max Ag, 0.05 max Si, 0.05 max Fe, 0.09-0.13 Zr, 0-0.05 Ti, and the balance Al and incidental impurities.

21. The extruded aluminum alloy product of claim 19, wherein the extruded aluminum alloy product has a density of less than 0.096 lbs/in$^3$.

22. The extruded aluminum alloy product of claim 19, wherein the L-T fracture toughness $K_Q$ is greater than 45 ksi √in.

23. The extruded aluminum alloy product of claim 19, wherein the extruded aluminum alloy product has a T-L fracture toughness $K_Q$ of greater than 31 ksi √in.

24. The extruded aluminum alloy product of claim 19, wherein the extruded aluminum alloy product has a tensile yield strength L-T TYS of greater than 64 ksi and a L tensile yield strength of greater than 71 ksi.

25. The extruded aluminum alloy product of claim 19, wherein the extruded aluminum product has a first section having a higher aspect ratio than a second section, and at least one transition zone extending into the first and second sections, and the extruded aluminum alloy product has an off-axis OA three-point bend displacement d measured at the at least one transition zone of greater than 0.8 mm as measured per EN 2563.

26. The extruded aluminum alloy product of claim 19, wherein the extruded aluminum alloy product has an exfoliation corrosion rating of at least EB.

27. The extruded aluminum alloy product of claim 19, wherein the extruded aluminum alloy product is solution heat treated, stretched, and artificially aged.

28. The extruded aluminum alloy product of claim 27, wherein the extruded aluminum alloy product is artificially aged to a peak aged temper.

29. An extruded aluminum alloy product comprising from, in weight percent, 2.7-2.9 Cu, 1.55-1.75 Li, 0.3-0.4 Mg, 0.1-0.2 Mn, 0.2 max Zn, 0.05 max Ag, 0.05 max Si, 0.07 max Fe, 0.09-0.13 Zr, 0-0.06 Ti, and the balance Al and incidental impurities, wherein the extruded aluminum alloy product comprises ≤25% recrystallized grains, and has a L tensile yield strength of greater than 74 ksi.

30. The extruded aluminum alloy product of claim 29, comprising from, in weight percent, 2.7-2.9 Cu, 1.6-1.7 Li, 0.3-0.4 Mg, 0.1-0.2 Mn, 0.05 max Zn, 0.05 max Ag, 0.05 max Si, 0.05 max Fe, 0.09-0.13 Zr, 0-0.05 Ti, and the balance Al and incidental impurities.

31. The extruded aluminum alloy product of claim 29, wherein the extruded aluminum alloy product has a density of less than 0.096 lbs/in$^3$.

32. The extruded aluminum alloy product of claim 29, wherein the L tensile yield strength is greater than 76 ksi.

33. The extruded aluminum alloy product of claim 29, wherein the extruded aluminum alloy product has a tensile yield strength L-T TYS of greater than 68 ksi.

34. The extruded aluminum alloy product of claim 29, wherein the extruded aluminum alloy product has a L-T fracture toughness $K_Q$ of greater than 34 ksi √in and a T-L fracture toughness $K_Q$ of greater than 29 ksi √in.

35. The extruded aluminum alloy product of claim 29, wherein the extruded aluminum product has a first section having a higher aspect ratio than a second section, and at least one transition zone extending into the first and second sections, and the extruded aluminum alloy product has an off-axis OA three-point bend displacement d measured at the at least one transition zone of greater than 0.55 mm as measured per EN 2563.

36. The extruded aluminum alloy product of claim 29, wherein the extruded aluminum alloy product has an exfoliation corrosion rating of at least EB.

37. The extruded aluminum alloy product of claim 29, wherein the extruded aluminum alloy product is solution heat treated, stretched, and artificially aged to an under-aged temper.

38. A method of making an extruded aluminum alloy product of claim 1, the method comprising:

homogenizing a cast billet or shape of the aluminum alloy;

hot working the billet or shape into an extruded product;

subjecting the extruded product to a solution heat treatment at a temperature of from 940° F. to 1020° F.;

quenching the solution heat treated extruded product;

stretching the extruded product to a permeant set of 3-9%; and artificially aging the extruded product by heating to at least one temperature of from 290° F. to 315° F. for 36-100 hours.

39. The method of making the extruded aluminum alloy product of claim 38, wherein the homogenization of the billet or shape comprises a first homogenization step at a temperature of from 820° F. to 870° F. for a treatment time between 10 to 20 hours, and a second homogenization step at a temperature greater than 940° F. for a treatment time between 5 to 25 hours.

40. The method of making the extruded aluminum alloy product of claim 38, wherein the extruded product is artificially aged such that the equivalent time at 305° F. using a Q=85.271 kJ/mol and R=8.314462 $JK^{-1}$ $mol^{-1}$ is 42-54 hours.

41. The method of making the extruded aluminum alloy product of claim 38, further comprising natural aging the extruded product for less than or equal to 24 hours before stretching.

42. The method of making the extruded aluminum alloy product of claim 38, wherein the extruded aluminum alloy is subjected to a natural aging period of at least 48 hours between stretching and artificial aging the extruded alloy.

43. The method of making the extruded aluminum alloy product of claim 38, wherein the extruded aluminum alloy product has a L tensile yield strength of at least 65 ksi and an elongation L of greater than 10.5 percent.

44. The method of making the extruded aluminum alloy product of claim 38, wherein the extruded aluminum alloy product has a density of less than 0.096 lbs/in$^3$.

45. A method of making an extruded aluminum alloy product of claim 1, the method comprising:

homogenizing a cast billet or shape of the aluminum alloy;

hot working the billet or shape into an extruded product;

subjecting the extruded product to a solution heat treatment at a temperature greater than or equal to 970° F.;

quenching the solution heat treated extruded product;

stretching the extruded product to a permeant set of 3-9%; and artificially aging the extruded product by heating to at least one temperature of from 290° F. to 315° F. for 12-36 hours.

46. The method of making the extruded aluminum alloy product of claim 45, wherein the extruded product is subjected to a solution heat treatment temperature of from 1000° F. to 1020° F.

47. The method of making the extruded aluminum alloy product of claim 45, wherein the extruded product is stretched to a permeant set of 3-6%.

48. The method of making the extruded aluminum alloy product of claim 45, wherein the homogenization of the billet or shape comprises a first homogenization step at a temperature of from 820° F. to 870° F. for a treatment time between 10 to 20 hours, and a second homogenization step at a temperature greater than 940° F. for a treatment time between 5 to 25 hours.

49. The method of making the extruded aluminum alloy product of claim 45, wherein the extruded product is artificially aged such that the equivalent time at 305° F. using a Q=85.271 kJ/mol and R=8.314462 JK$^{-1}$ mol$^{-1}$ is 14-19 hours.

50. The method of making the extruded aluminum alloy product of claim 45, further comprising natural aging the extruded product for less than or equal to 24 hours before stretching.

51. The method of making the extruded aluminum alloy product of claim 45, wherein the extruded aluminum alloy is subjected to a natural aging period of at least 48 hours between stretching and artificial aging the extruded alloy.

52. The method of making the extruded aluminum alloy product of claim 45, wherein the extruded aluminum alloy product has a L tensile yield strength of at least 64 ksi and a L-T fracture toughness $K_Q$ of at least 60 ksi √in.

53. The method of making the extruded aluminum alloy product of claim 52, wherein the extruded aluminum alloy product has a fatigue crack growth rate less than or equal to 1E-8 (ΔK)^2.4994 when Δk=30-50 ksi √in.

54. The method of making the extruded aluminum alloy product of claim 52, wherein the extruded aluminum alloy product has an exfoliation corrosion rating of at least EB.

55. The method of making the extruded aluminum alloy product of claim 45, wherein the extruded aluminum alloy product has a density of less than 0.096 lbs/in$^3$.

* * * * *